US008863751B2

(12) United States Patent
Demmer et al.

(10) Patent No.: US 8,863,751 B2
(45) Date of Patent: Oct. 21, 2014

(54) APPARATUS FOR FILLING CIGARETTE TUBES WITH TOBACCO

(75) Inventors: Udo Demmer, Pinneberg (DE); Henning Seidel, Mechtersen (DE); Heiner Burghart, Holm (DE); Sara Temple, Chalfont St. Peter (GB); Regine Wolfgramm, Hamburg (DE); Jan Fuhrmann, Hamburg (DE); Inga Gurke, Hamburg (DE); Holger Fleischhauer, Hamburg (DE); Gabriele Hinsch-Obermann, Halstenbek (DE)

(73) Assignee: Reemtsma Cigarettenfabriken GmbH, Hamburg (DE)

( * ) Notice: Subject to any disclaimer, the term of this patent is extended or adjusted under 35 U.S.C. 154(b) by 1009 days.

(21) Appl. No.: 12/922,844

(22) PCT Filed: Mar. 17, 2009

(86) PCT No.: PCT/EP2009/001961

§ 371 (c)(1),
(2), (4) Date: Dec. 6, 2010

(87) PCT Pub. No.: WO2009/115297

PCT Pub. Date: Sep. 24, 2009

(65) Prior Publication Data

US 2011/0114104 A1 May 19, 2011

(30) Foreign Application Priority Data

Mar. 17, 2008 (EP) ..... 08400012

(51) Int. Cl.
*A24C 5/40* (2006.01)
*A24C 5/42* (2006.01)

(52) U.S. Cl.
CPC .... *A24C 5/42* (2013.01); *A24C 5/40* (2013.01)
USPC ..... 131/70

(58) Field of Classification Search
CPC ..... A24C 5/40; A24C 5/06; A24C 5/02; A24C 5/42
See application file for complete search history.

(56) References Cited

U.S. PATENT DOCUMENTS 2,731,971 A 1/1956 Kastner
3,127,900 A 4/1964 Kastner
(Continued)

FOREIGN PATENT DOCUMENTS

DE 202005012273 U1 11/2005
EP 0584805 A1 3/1994
(Continued)

*Primary Examiner* — Michael J Felton
(74) *Attorney, Agent, or Firm* — Hovey Williams LLP

(57) ABSTRACT

An apparatus (1) for filling cigarette tubes with tobacco comprises a base (10), a magazine chamber (2) adapted to receive a supply of tobacco (T), a lid (20) adapted to close a top of the magazine chamber (2), a filling chamber (4) adapted to receive the tobacco to be filled into a cigarette tube, a stamp (30) adapted to shape the tobacco of the filling chamber (4), and a slider arranged in the filling chamber (4) which transfers the tobacco of the filling chamber (4) into a cigarette tube supported in front of the filling chamber (4). A press-down lever (6) is connected to the stamp (30) and to a coupling mechanism in order to move the slider after actuation of the stamp (30). A pusher for forwarding the tobacco in the magazine chamber can also be coupled to the press-down lever.

42 Claims, 18 Drawing Sheets

(56) References Cited

U.S. PATENT DOCUMENTS

Figure 1:
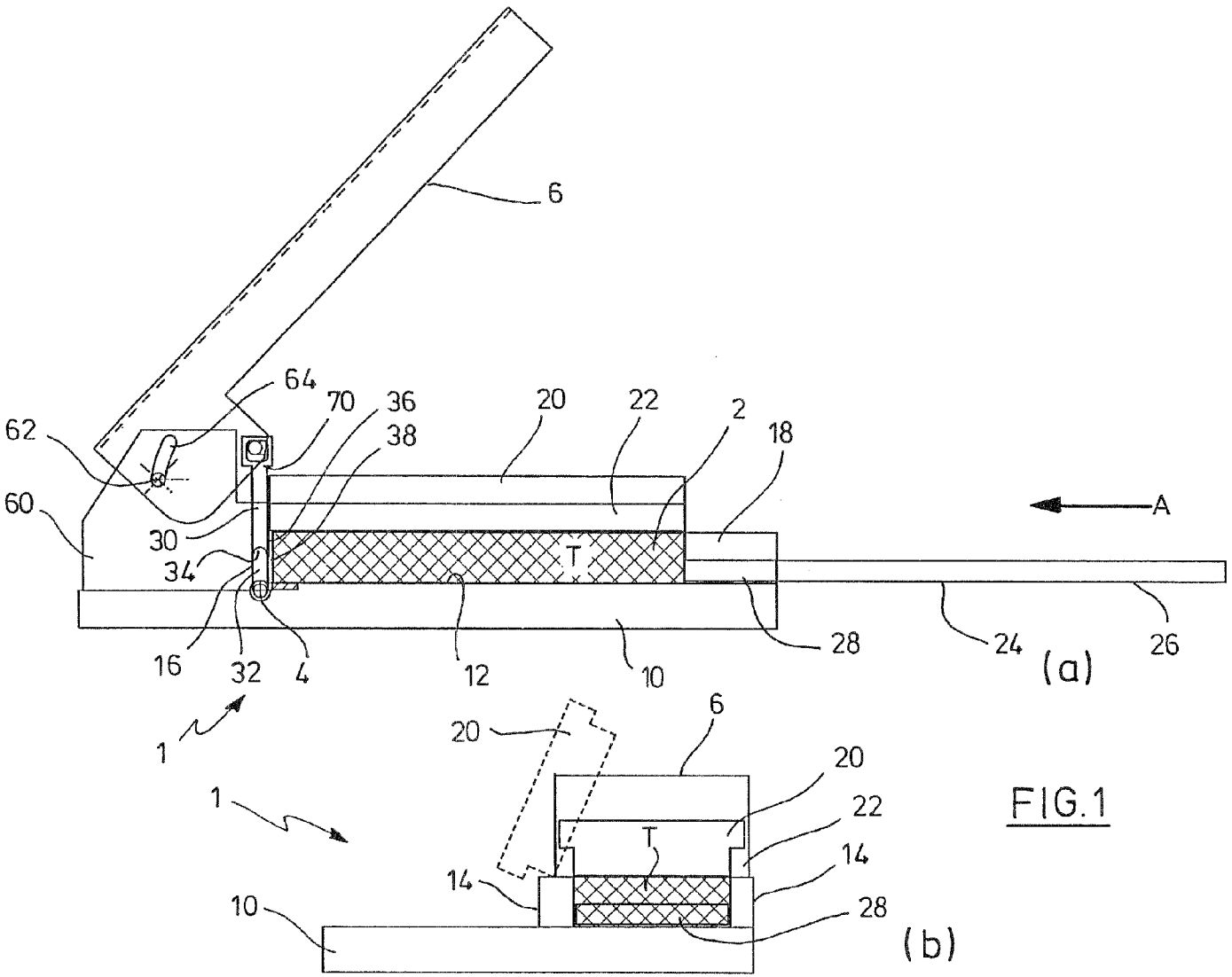

| | | | | |
|---|---|---|---|---|
| 4,303,082 | A | 12/1981 | Thompson et al. | |
| 4,411,278 | A | 10/1983 | Kastner | |
| 5,088,506 | A * | 2/1992 | Kastner | 131/70 |
| 2007/0193591 | A1 | 8/2007 | Andersen et al. | |
| 2007/0289601 | A1 | 12/2007 | Pham et al. | |

FOREIGN PATENT DOCUMENTS

| | | | |
|---|---|---|---|
| GB | 1335640 | A | 10/1973 |
| WO | 2007007197 | A2 | 1/2007 |
| WO | 2007082939 | A1 | 7/2007 |

* cited by examiner (a)
(b)
200
202
204
206
210
212
216
218
220
224
226
260
300
302
304
306
308
310
312
314
316

APPARATUS FOR FILLING CIGARETTE TUBES WITH TOBACCO

CROSS-REFERENCE TO RELATED APPLICATION

This is a National Phase Application pursuant to 37 C.F.R. §371 of International Application No. PCT/EP2009/001961, filed Mar. 17, 2009, claiming priority from European Application No. EP 08400012.4, filed Mar. 17, 2008, the entire disclosures of both of which are hereby incorporated by reference herein.

BACKGROUND OF THE INVENTION

1. Field of the Invention

The invention relates to an apparatus for filling cigarette tubes with tobacco as well as to a system comprising such apparatus plus prepared tobacco to be used with the apparatus.

2. Discussion of the Prior Art

For self-manufacturing cigarettes, a consumer can put loose tobacco on a paper sheet, roll the paper sheet about the tobacco and glue one longitudinal edge of the paper sheet to the opposite edge. This way of rolling a cigarette can be supported by small cigarette rolling devices.

It is more convenient to use pre-fabricated cigarette tubes which can comprise a filter at one of its ends. Devices for filling such cigarette tubes with tobacco have been known for a long time.

For example, DE 20 2005 012 273 U1 discloses an apparatus for filling cigarette tubes with tobacco, which comprises an elongate filling chamber which is accessible via an elongate filling port at its top side. The filling port is surrounded by a wall, thus forming a kind of trough. In order to prepare a cigarette, a single tobacco portion is filled into that trough and transferred into the filling chamber by means of a protrusion formed at the bottom side of a lid, when that lid is placed on the top side of the trough. In this way, the tobacco is compressed. In the next step, a slider arranged in the filling chamber is moved in the longitudinal direction thereof towards an opening in an end side of the filling chamber, thus transferring the tobacco from the filling chamber via that opening into a cigarette tube supported in front of the opening. This devices works well, but its disadvantage is that it has to be re-filled with tobacco for each cigarette.

Another apparatus for filling cigarette tubes with tobacco is known from U.S. Pat. No. 2,731,971. It comprises a tobacco chamber to be filled with a single portion of tobacco. By rotating an actuating handle about an axis perpendicular to the base of the apparatus, in a first step, the tobacco is compressed inside the chamber and, in a second step, the compressed tobacco is transferred from the chamber into a cigarette tube mounted at an end side of the chamber. The compression device and the transferring device act in directions which are perpendicular to each other and are driven via leverage actuated by the rotatable handle. Improvements of this apparatus are disclosed in U.S. Pat. Nos. 3,127,900 and 4,411,278. It is disadvantageous that the tobacco chamber has to be filled for each cigarette to be made. Moreover, the handle has to be rotated in order to actuate this cigarette making apparatus which means that the user has to catch the base of the apparatus with the other hand in order to prevent the apparatus from rotating as a whole.

EP 0 584 805 A1 discloses an apparatus for filling pre-manufactured cigarette paper tubes which uses a supply of a prepared, coherent tobacco sufficient for more than one single cigarette portion. The tobacco is stored in a vertically arranged magazine chamber. By pushing the tobacco from its top side, it can be transferred, via an elongate filling port, into a filling or compressing chamber located at the bottom side of the magazine. In the next step, a compressing bar is moved transversely to the longitudinal direction of the filling chamber in order to compress the tobacco and to cut it by means of a knife mounted at the top side of the compressing bar from the tobacco in the magazine. By actuating a slider or ejection pusher arranged in the filling chamber, the tobacco is transferred into the cigarette tube mounted at one end side of the filling chamber by means of a nozzle or tubular socket. The compression bar and the ejection pusher are operated independently by two different means so that the handling of this apparatus is not very convenient. Another disadvantage is that specially prepared tobacco has to be used.

WO 2007/082939 A1 discloses a device for filling cigarette tubes with tobacco which utilises a prepared tobacco block. The tobacco block is horizontally arranged and pushed towards a shaping block where a portion is cut by means of a vertically moving knife and formed to a shape having an essentially circular cross-section. By means of a slider, the shaped tobacco portion is transferred into a cigarette tube mounted at an end side of the shaping block. The pushing direction of the tobacco block, the moving direction of the knife and the moving direction of the slider are perpendicular to each other. The pusher can be automatically driven by a kind of ratchet device, coupled to the actuation of the shaping means (including the knife). The slider is handled independently thereof. This device requires a pre-shaped, pressed and coherent as well as wrapped tobacco block and cannot be used with ordinary loose tobacco.

Whereas the devices described so far are operated by hand, US 2007/0289601 A1 discloses a more sophisticated cigarette making apparatus with mechanical and electrical features, including an electronic display field.

SUMMARY

It is the object of the invention to provide a mechanical apparatus for filling cigarette tubes with tobacco, which can be handled in a convenient way, which is variable with respect to the kind of tobacco, and which, optionally, can be used with ordinary loose tobacco and operated in an individual manner.

This object is achieved by the apparatus for filling cigarette tubes with tobacco including a coupling mechanism that is operatively connected to a press-down lever and that is adapted to move a slider after tobacco has been transferred to a filling chamber and shaped by a stamp. Advantageous versions of the invention, including details of construction, are also disclosed. In addition, a system comprising such an apparatus plus prepared tobacco for the application with the apparatus is also disclosed. The prepared tobacco defined in the system claims can also be considered as such, i.e. not in combination with the apparatus.

The apparatus according to the invention is used for filling cigarette tubes with tobacco. It comprises a magazine chamber adapted to receive a supply of tobacco. The tobacco can be prepared tobacco, for example comprising a block of coherent tobacco or comprising loose tobacco contained in a specially designed packaging, but ordinary loose tobacco can be filled into the magazine chamber as well. The magazine chamber includes a base wall, two side walls opposite to each other, a first end and a second end opposite to the first end. The top side of the magazine chamber is closed by a lid. The tobacco inside the magazine chamber can be moved towards the first end of the magazine chamber by means of a pusher.

The apparatus further comprises a filling chamber, in proximity to the first end of the magazine chamber (and preferably in the area of a base of the apparatus) defining a longitudinal direction transverse to the moving direction of the pusher. The filling chamber is adapted to receive the tobacco to be filled into the cigarette tube. A stamp is movable in a direction transverse to the moving direction of the pusher and transverse to the longitudinal direction of the filling chamber and is adapted to shape the tobacco of the filling chamber (which can include a transfer of tobacco from the magazine chamber into the filling chamber). In the filling chamber, there is arranged a slider which can be moved in the longitudinal direction of the filling chamber towards an opening in an end side of the filling chamber. The slider is adapted to transfer the tobacco of the filling chamber from the filling chamber via that opening into a cigarette tube, which is supported in front of the opening. The stamp is moved by means of a press-down lever which is also operatively connected to the slider. By actuating the press-down lever, the slider is moved after the tobacco has been transferred to the filling chamber and has been shaped by the stamp.

As already mentioned, an advantage of the apparatus according to the invention is the general possibility to use it with loose tobacco. This does not exclude the application of prepared tobacco, however. Advantageous embodiments of prepared tobacco are disclosed further below.

Generally, the design of the magazine chamber and the pusher enable the user to prepare cigarettes with an individually designed hardness or amount of tobacco. In an advantageous embodiment, the pusher comprises a manual actuating handle, which preferably is arranged at a shaft extending through an opening at the second end of the magazine chamber. Handle and shaft can be a unit, for example when the pusher is designed as a block. Thus, the user can individually push the tobacco towards the first end of the magazine chamber and the filling chamber, thereby influencing its state of compression.

This effect can be enhanced by a design in which the lid is slideably guided with respect to the magazine chamber and is adapted to decrease the volume of the magazine chamber by pressing the lid downwards. In this way, the user has two independent means for influencing the state of compression of the tobacco in the magazine chamber, i.e. a direct way by pressing the lid (which also improves the homogeneity of the tobacco) and a somewhat indirect way by operating the pusher which tends to gradually increase the density of the tobacco along the path to the filling chamber (which improves the homogeneity of the tobacco as well). For example, the density of the tobacco after entering the filling chamber can be larger than the initial density of the tobacco (just after filling into the magazine chamber and before closing the lid) by a factor of two or even more.

The lid can include guide means, for example a recessed step guided by the walls of the magazine chamber or guide means as designed in the second embodiment described in detail further below. Moreover, the lid can be connected to the magazine chamber by some swivelable means which also allow for moving the lid for adjusting the volume of the magazine chamber.

In advantageous embodiments of the invention, the shaft of the pusher comprises marks for indicating the path length the tobacco has already been moved by the pusher. In particular, there can be a start mark indicating a starting position of the pusher where the user should move the pusher before filling the first cigarette tube after re-filling the magazine chamber, in order to effect some pre-compression. The following marks can be arranged such that the user can move the pusher to the next mark in order to fill a tobacco portion for one cigarette into the filling chamber. As the density of the tobacco in the magazine chamber tends to increase when the pusher is moved towards the filling chamber, the distance between corresponding neighbouring marks can decrease in order to compensate for that effect, i.e. in order to end up with a roughly constant density of the tobacco in the filling chamber, irrespective of the position of the pusher. For example, when the magazine chamber is designed to accommodate a tobacco amount sufficient for 30 cigarettes, the shaft of the slider can be provided with about 30 marks. A fixed reference mark for reading the marks at the shaft of the pusher can be located, e.g., at the second end of the magazine chamber or at a transparent part of the lid (wherein the lid is made of a transparent material or the lid includes a transparent part like a transparent window).

In other advantageous embodiments of the invention, a second coupling mechanism is operatively connected to the press-down lever and is adapted to move the pusher before or during the initial movement of the stamp, as disclosed in more detail further below. This results in an apparatus in which the pusher is forwarded automatically when the press-down lever is actuated. The operation of such apparatus is very convenient.

In particular in the more automated embodiments, the lid can be designed such that it is not removable from the magazine chamber. In this case, tobacco or prepared tobacco (e.g., tobacco taken from a packaging adapted to the use with the apparatus) can be filled into the magazine chamber via its second end. In order to adjust the position of the lid to decrease the volume of the magazine chamber, an eccentric cam drive can be provided, which is adapted to move the lid upwards and downwards. For example, the cam drive can comprise a cam guide, which is connected, via connectors, to the lid and which engages with an eccentrically mounted, rotatable actuator, wherein preferably a stable lower position of the lid and a stable upper position of the lid are provided by the cam drive. A detailed embodiment of such convenient lid adjustment device, wherein the cam drive also provides a stable lower position of the lid and a stable upper position of the lid, is given further below.

Generally, the good overall homogeneity of the tobacco in the filling chamber achieved by the action of the lid and the pusher finally results in a generally homogeneous density of the tobacco in the cigarette tube, which improves the quality of the cigarette.

In principle, the stamp could separate the tobacco to be transferred into the filling chamber from the rest of the tobacco of the magazine chamber when it is moved, i.e. in a generally vertically downward direction. It is advantageous, however, to provide a cutter for severing the tobacco during this operating step. Preferably, the cutter is fixedly attached to the stamp, wherein, e.g., the cutting edge protrudes from the lower side of the stamp. In this way, when the press-down lever is initially pressed down, the pusher shapes the tobacco portion to be transferred into the filling chamber, and at the same time, the cutter cuts this tobacco from the rest of the tobacco in the magazine chamber.

The cigarette tube can be supported by a tubular socket arranged about the opening of the filling chamber. Preferably, the tubular socket comprises a step on its inner surface. This step acts as a kind of check valve. It allows an unimpeded passage of the tobacco from the filling chamber into the cigarette tube, but when afterwards the slider is retracted into the filling chamber, it cannot retract tobacco because now the tobacco abuts against the step which keeps the tobacco inside the cigarette tube in spite of some frictional forces between the tobacco and the slider. The cigarette tube can be held at the tubular socket by, e.g., an elastic or spring-biased clamp.

Preferably, the slider comprises a tongue-like extension emerging from a piston-like inner part, wherein the tongue-like extension protrudes into the cigarette tube when the slider is moved towards the opening of the filling chamber. This design is known from the prior art documents discussed above.

The stamp is used to support the transfer of tobacco into the filling chamber and to shape that tobacco, as already indicated above. To this end, in the lower-most position of the stamp, the cross-sectional shape of the filling chamber preferably is generally circular-like, including its upper portion defined by the stamp.

A particular advantage of the apparatus according to the invention is its convenient handling. On the one hand, the magazine chamber is easily accessible, via its lid or via its second end, and the tobacco can be homogenized and compressed (individually or automatic) before and when it is transferred to the filling chamber, and on the other hand, by a simple press-down operation of the lever, the tobacco is shaped (when moved into the filling chamber) and afterwards is transferred into the cigarette tube. This press-down operation can be easily performed with one hand (without any need to hold the apparatus with the other hand) and is generally more effective than the operation of the prior art devices discussed above. The coupling mechanism between the press-down lever and the stamp as well as the slider can be designed in several ways. The following example is an advantageous embodiment.

In this embodiment, the press-down lever has two fulcra, a first fulcrum and a second fulcrum, which are adapted to act as fulcra during different parts of the actuation of the press-down lever. That means, the press-down lever rotates about different axes during different parts of its actuation. In this way, the first fulcrum acts as a fulcrum (i.e., the actuating lever rotates about the first fulcrum as a fixed axis) and the second fulcrum moves downwards during the first part of the travel of the press-down lever which is associated to the movement of the stamp. During the second part of the travel of the press-down lever, which is associated to the movement of the slider, the second fulcrum acts as a fulcrum (i.e. the press-down lever rotates about a fixed axis through the second fulcrum), while the first fulcrum moves upwards.

In this design, the first fulcrum can be held in position by spring means as long as it acts as a fulcrum. The second fulcrum can be formed at a stop face which limits the first part of the travel of the press-down lever. That means, during the second part of the travel of the press-down lever, the press-down lever rotates about the stop face acting as the fulcrum, while the location of the first fulcrum is raised against the spring force.

In an even more elegant design, the first fulcrum is adapted to be held in position by a protrusion provided at a first guide track as long as it acts as a fulcrum and the second fulcrum, being guided by a second guide track, moves downwards during the first part of the travel of the press-down lever. The second guide track is formed to release the first fulcrum when the second fulcrum reaches a stop at the lower end of the second guide track, which limits the first part of the travel of the press-down lever and defines the position of the second fulcrum as long as it acts as a fulcrum. Then the first fulcrum is raised along the first guide track during the second part of the travel of the press-down lever. Details of this design are presented further below.

The coupling mechanism adapted to move the slider can comprise an elbow lever having a first arm and a second arm, wherein the first arm is operatively linked to the first fulcrum and the second arm is adapted to move roughly in parallel to the travel direction of the slider when the first fulcrum is raised. By carefully designing the angle of the elbow lever and the leverages, it is possible to transmit the movement of the press-down lever into a movement of elements located essentially in the plane of the base of the apparatus. Via additional linkage, such elements can be easily connected to the slider to enable the desired movement of the slider during the second part of the travel of the press-down lever.

As already mentioned, in advantageous embodiments of the apparatus according to the invention, a second coupling mechanism is operatively connected to the press-down lever and is adapted to move the pusher before or during the initial movement of the stamp. Thus, the movement of the tobacco in the magazine chamber is also achieved by means of the press-down lever.

For example, the second coupling mechanism can comprise a rack having teeth means and being provided at the pusher and extending in the moving direction of the pusher, a claw adapted to engage at the rack, and a reciprocating device coupled to the movement of the stamp and adapted to pull the claw from an initial position towards the first end of the magazine chamber during the initial movement of the stamp and to move the claw back to its initial position, wherein preferably the teeth means and the claw are formed to enable the claw to move back to its initial position without shifting the rack. During the latter step, the rack can be held in position by an additional claw, as explained in more detail further below.

The spacing of the teeth means at the rack preferably decreases towards the end of the rack being closer to the second end of the magazine chamber. This allows for the effect that the tobacco in the magazine chamber is gradually compressed when it is transported towards the first end of the magazine chamber and results in about equal masses of the tobacco portions transferred into the filling chamber. The travel of the claw should be larger than the maximum spacing of the teeth means and smaller than twice the minimum spacing of the teeth means so that, during each reciprocating cycle of the claw, the rack proceeds in register with the actual teeth spacing.

Preferably, the distance between the base wall and the lid, when the lid is in its lower-most position and closes the top side of the magazine chamber, increases in the moving direction of the pusher towards the first end of the magazine chamber. Thus, the magazine chamber has the shape of an "inverse" funnel, which facilitates the movement of the tobacco in the magazine chamber in spite of its gradual compression.

It is advantageous when the press-down lever can be swivelled or moved from an operating position into a space-saving resting position, where, preferably, it can be fixed by means of a locking mechanism.

Advantageous embodiments of prepared tobacco comprise, for example, loose tobacco (which term also includes somewhat pre-compressed tobacco) contained in a packaging which includes an insert fitting into the magazine chamber and supporting the tobacco as well as a closing device. The insert facilitates the loading of the magazine chamber. For example, the insert can comprise a trough-like part having a bottom wall and two side walls opposite to each other and being open at both end sides, wherein the bottom wall and the side walls of this part fit into gaps between the pusher and the base wall and the side walls, respectively, of the magazine chamber. The closing device can be designed as an envelope which encloses the insert including the tobacco and is removed before the insert including the tobacco is put into the magazine chamber. In other designs, as described below in more detail, the closing device comprises a lid or a (preferably flexible) cover which may be completely or partially removed when the insert including the tobacco is put into the magazine chamber.

Other advantageous embodiments of prepared tobacco do not use a trough-like part.

For example, the prepared tobacco can comprise loose tobacco contained in a packaging having a box shape with two major lateral walls, two minor lateral walls and two end walls, which is adapted to the size of the magazine chamber, wherein both end walls are attached via weakening zones, preferably perforations and/or glue areas (preferably with a weak glue).

In order to fill the tobacco from this packaging into the magazine chamber, both end walls of the packaging are removed, the pusher is retracted from the magazine chamber via its second end and the lid is lifted to a raised position, one end side of the packaging is placed at the second end of the magazine chamber (preferably in a guide means including an abutment face), and the pusher is introduced through the other end side of the packaging into the packaging in order to push the tobacco through the packaging and through an opening at the second end of the magazine chamber, until all tobacco has entered the magazine chamber. Preferably, the size of the pusher is adapted to the size of the magazine chamber when the lid is in a lower position, but the pusher can have one end side of greater height, which is used during the process just described. Once all tobacco has entered the magazine chamber (without the packaging), the pusher is reversed and introduced into the magazine chamber again to adopt its working position; the lid is moved downwards. Since the packaging is adapted to the size of the magazine chamber, the correct amount of tobacco is filled in, which results in a well-defined initial density of the tobacco in the magazine chamber and in well-defined initial conditions for the subsequent use of the apparatus.

In a similar design, the packaging is adapted to the width and the height of the magazine chamber, but the length of the packaging is greater than the distance between the first end and the second end of the magazine chamber. Again, both end walls of the packaging are attached via weakening zones, preferably perforations and/or glue areas, which allow for an easy removal of the end walls. Such packaging can be filled with an amount of tobacco (e.g., with 30 g or more) which is greater than the filling capacity of the magazine chamber (e.g., 17 g).

For example, the length of the packaging can be about twice the distance between the first end and the second end of the magazine chamber, wherein the packaging has a weakening zone adapted to split the packaging into two parts, each having a length of about the distance between the first end and the second end of the magazine chamber. Preferably, the weakening zone is a perforation line running about the circumference of the packaging. In this case, the packaging can be broken or torn into two parts. One part is used immediately, as described before. The opening of the other part, which was created by the separating process, can be closed by the user in order to keep fresh the tobacco in this part. Optionally, closing means are provided with the packaging for this purpose.

The packaging can be folded from a blank which is adapted to allow access to the interior of the packaging for filling purposes via a lateral side before this lateral side is closed to form one of the minor lateral walls. The filling of the packaging via a lateral wall is more reliable than the filling via an end side, which could result in an undesired compression of the tobacco in the packaging and in inhomogeneities.

Preferably, the end walls of the packaging comprise at least one gripping tab adapted to facilitate removal of the respective end wall.

Other designs of packagings which contain more tobacco than the filling capacity of the magazine chamber are conceivable as well. For example, the prepared tobacco can comprise loose tobacco contained in a packaging having two compartments, each compartment being adapted to the size of the magazine chamber, wherein the compartments are arranged side by side and the packaging comprises, at least at one end side, an end wall which is attached via weakening zones, preferably perforations and/or glue areas, and which also forms the respective end walls of both compartments. In this case, both compartments are opened when this end wall is removed. In an advantageous version of this design, each compartment is formed as a partial packaging having a box shape with two major lateral walls, two minor lateral walls and two end walls and being adapted to the size of the magazine chamber, wherein both partial packagings are connected, at least at one end side, via a common end wall which is, at least partially, attached via weakening zones, preferably perforations and/or glue areas. At least at one end side of the packaging, the respective end wall can be adapted to remain at one of the partial packagings after use of the other partial packaging and to form a closure for the end side of that partial packaging in order to keep fresh the tobacco in that partial packaging.

In another design of a double-pack, two packagings of the box type with removable end walls and fitted to the size of the magazine chamber, as described before, are arranged side by side to form an arrangement. At least one end side of the arrangement, the end sides of both packagings are connected by a common end side cover, e.g. a flap means or a tape. When the user removes the common end side cover, the end sides of both packagings are simultaneously opened. The packagings can be arranged such that they touch each other at minor lateral sides or at major lateral sides.

An advantageous material for the packagings is, e.g., aluminium-laminated cardboard. Moreover, the packagings can be enclosed by an envelope made of a polymer film, e.g. of oriented polypropylene of 16 μm, which is removed before use.

Generally, the humidity of the tobacco in the packagings should be relatively low, preferably below 15% or around 12%. Such humidity improves the transport properties of the tobacco in the magazine chamber. Moreover, the density of the tobacco in the packagings should be relatively small, preferably below 150 mg/cm$^3$ or even below 100 mg/cm$^3$, which also facilitates the transport of the tobacco in the magazine chamber and results in a better homogenisation during the compression by the lid, the pusher and the stamp.

BRIEF DESCRIPTION OF THE DRAWING FIGURES

In the following, the invention is described in more detail by means of embodiments. The drawings show in FIG. 1 a schematic representation of a first embodiment of the apparatus according to the invention after tobacco has been filled into the magazine chamber, i.e. in part (a) in longitudinal section and in part (b) in end side view when looking in the direction of arrow A, FIG. 2 a schematic representation of the first embodiment after the tobacco in the magazine chamber has been compressed by pressing the lid downwards, i.e. in part (a) in longitudinal section and in part (b) in end side view when looking in the direction of arrow A, FIG. 3 a schematic representation of the first embodiment after the tobacco in the magazine chamber has been pushed towards the opposite end side, i.e. in part (a) in longitudinal section and in part (b) in end side view when looking in the direction of arrow A, FIG. 4 a schematic representation of the first embodiment after the press-down lever has been moved over its first part of travel and tobacco has been transferred into the filling chamber, i.e. in part (a) in longitudinal section, in part (b) in schematic section through a plane defined by the base of the apparatus, and in part (c) in cross section through a plane indicated by axis B in part (a), the planes in parts (b) and (c) being perpendicular to the paper plane of part (a), FIG. 5 a schematic representation of the first embodiment after the press-down lever has finished its complete travel and a tobacco portion has been transferred from the filling chamber into a cigarette tube, i.e. in part (a) in longitudinal section, in part (b) in schematic section through a plane defined by the base of the apparatus, in part (c) in cross section through a plane indicated by axis B in part (a), the planes in parts (b) and (c) being perpendicular to the paper plane of part (a), and in part (d) a detail of part (c), FIG. 6 a three-dimensional view of a first embodiment of a prepared-tobacco packaging, FIG. 7 parts (a) and (b) a three-dimensional view of a second embodiment of a prepared-tobacco packaging, FIG. 8 a three-dimensional view of a third embodiment of a prepared-tobacco packaging, FIG. 9 a schematic representation of a second embodiment of the apparatus according to the invention after tobacco has been filled into the magazine chamber when the pusher is still in a position used for filling in the tobacco, i.e. in part (a) in longitudinal section, in part (b) a detail of part (a) in enlarged view, in part (c) in schematic section through a plane in parallel to the base, and in part (d) in schematic cross section in the region of the press-down lever, FIG. 10 a schematic representation, in longitudinal section, of the second embodiment after the pusher has been reversed and after the tobacco in the magazine chamber has been compressed by moving the lid downwards, FIG. 11 a schematic representation similar to that of FIG. 10, which shows details of the moving mechanism of the pusher, i.e. in part (a) in longitudinal section and in part (b) in schematic section through a plane in parallel to the base in the upper area of the base, FIG. 12 a schematic representation, in longitudinal section, of the second embodiment after the press-down lever has been initially actuated and the tobacco has been forwarded by the pusher, FIG. 13 a schematic representation of the second embodiment, in longitudinal section, after the press-down lever has been moved over its first part of travel and tobacco has been transferred into the filling chamber, FIG. 14 a schematic representation of the second embodiment after the press-down lever has finished its complete travel and a tobacco portion has been transferred from the filling chamber into a cigarette tube (not shown), i.e. in part (a) in longitudinal section, in part (b) in schematic section through a plane defined by the base of the apparatus, and in part (c) in cross section through a plane indicated by axis C in part (b), the planes in parts (b) and (c) being perpendicular to the paper plane of part (a), FIG. 15 a schematic representation, in longitudinal section, of the second embodiment when the press-down lever is turned to a resting position, FIG. 16 a three-dimensional view of another embodiment of a prepared-tobacco packaging, FIG. 17 a blank for the packaging of FIG. 16, FIG. 18 a blank for a packaging similar to that of FIG. 16, FIG. 19 a three-dimensional view of another embodiment of a prepared-tobacco packaging, which is designed as a double pack, FIG. 20 a three-dimensional view of another embodiment of a prepared-tobacco packaging, which is designed as a double pack, FIG. 21 a three-dimensional view of another embodiment of a prepared-tobacco packaging, which is designed as a double pack, FIG. 22 a three-dimensional view of another embodiment of a prepared-tobacco packaging, which is designed as a double pack, and FIG. 23 a three-dimensional view of still another embodiment of a prepared-tobacco packaging, which again is designed as a double pack.

DETAILED DESCRIPTION OF THE PREFERRED EMBODIMENTS

FIGS. 1 to 5 represent consecutive steps in the application of an apparatus 1 for filling cigarette tubes with tobacco. In FIG. 1, tobacco T, for example loose tobacco, has been filled into a magazine chamber 2. When a lid on the top side of the magazine chamber 2 is closed, the tobacco T can be compressed, see FIG. 2. In the next step, the tobacco T is moved by means of a pusher and transferred into the area of a filling chamber 4, see FIG. 3. Afterwards, a press-down lever 6 is operated, i.e. pressed down, thereby shaping the tobacco in the filling chamber 4. Finally, during the second part of its travel, the press-down lever 6 operates a coupling mechanism which drives a slider in order to transfer the tobacco from the filling chamber 4 into a cigarette tube 8 mounted at an end of filling chamber 4, see FIG. 5.

As shown in FIGS. 1(*a*) and 1(*b*), the apparatus 1 comprises a base 10. A base wall 12, designed as part of the base 10, forms the bottom of magazine chamber 2. Moreover, the magazine chamber 2 comprises two side walls 14 which run in parallel to the arrow A in FIG. 1(*a*). In this direction, the magazine chamber 2 extends from a first end wall 16 to a second end wall 18. As is evident from the figures, the magazine chamber 2 is generally horizontally oriented.

The top side of magazine chamber 2 can be closed by a lid 20. At its longitudinal side edges, lid 20 is provided with guide steps 22, see FIG. 1(*b*). The lid 20 can be a separate part, as suggested by the figures, but it can also be connected to the walls of the magazine chamber 2, e.g., by hinge means.

FIG. 1 shows a state just after loose tobacco T has been filled into the magazine chamber 2, almost up to the upper edges of the side walls 14 and the second end wall 18. Now, when pressing onto the top side of the lid 20, the user of apparatus 1 can compress the tobacco T. The highest compression state is achieved when the guide steps 22 of lid 20 abut against the upper edges of the side walls 14, but the guide steps 22 allow a smaller compression state as well. At this stage, the user can freely select the compression state of the tobacco T according to his or her preferences. The compression state is also dependent on the total amount of tobacco T filled into the filling chamber 4 at the beginning, i.e. on its initial level in the filling chamber 4.

Figure 2:
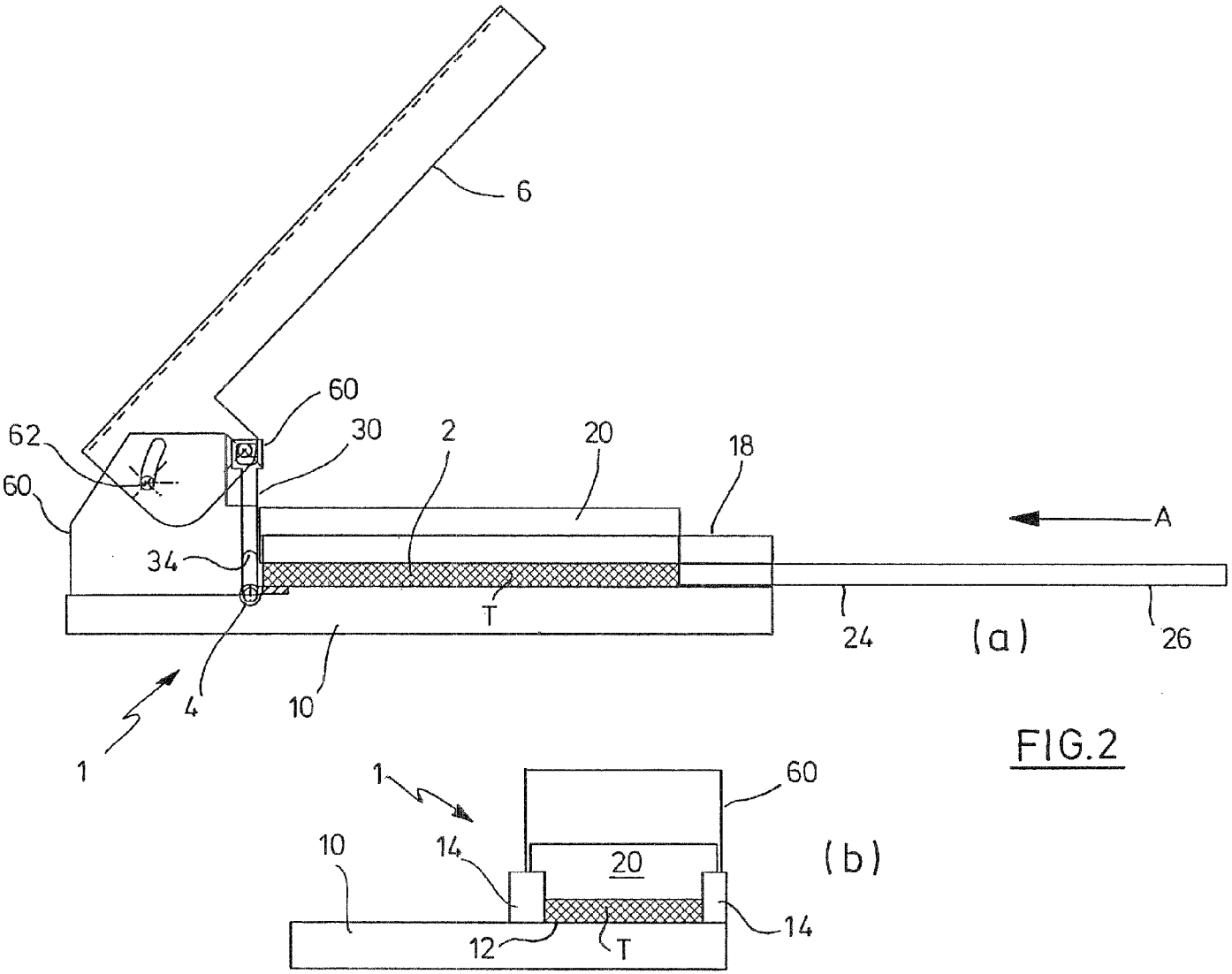

Moreover, FIGS. 1 and 2 show a pusher 24, which is designed as an elongate bar in the embodiment. The accessible portion of the pusher 24 can be defined as handle 26. The pusher 24 extends through a rectangular opening 28 in the second end wall 18, see FIGS. 1(*b*) and 2(*b*). Due to its considerable thickness, the second end wall 18 acts as a guide for the pusher 24, see FIGS. 1(*a*) and 2(*a*).

Figure 3:
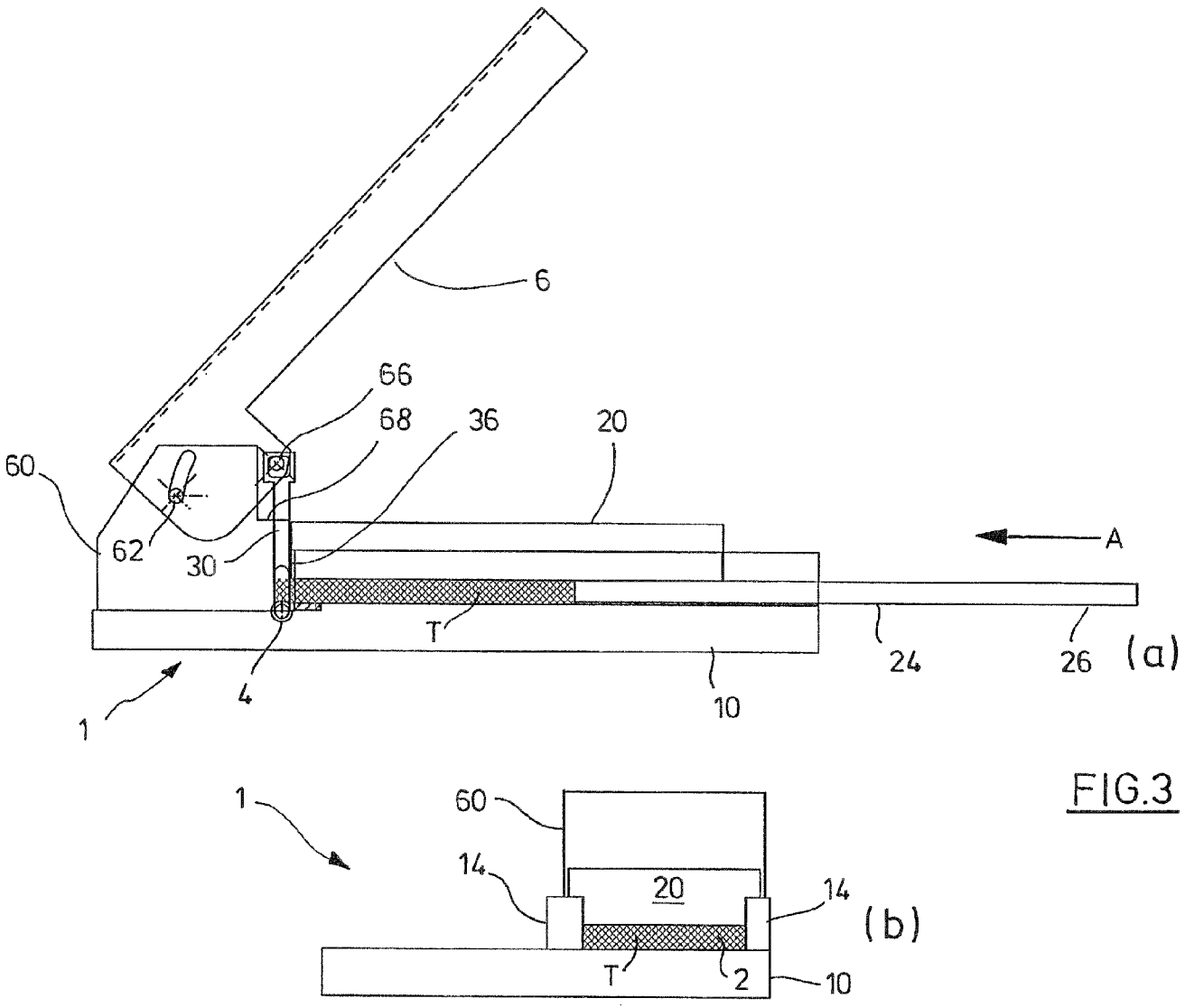

In order to move tobacco T towards the first end 16 of the magazine chamber 2, i.e. into the vicinity of filling chamber 4, the pusher 24 is pushed into the direction of arrow A. In this way, the tobacco T is transported inside magazine chamber 2. Compared to FIGS. 1 and 2, FIG. 3 shows a state when part of the tobacco supply has already been used for making cigarettes so that the total amount of tobacco T inside the magazine chamber 2 according to FIG. 3 is smaller than according to FIGS. 1 and 2. Due to frictional forces, the density of the tobacco T increases somewhat when the pusher 24 is moved further towards the first end 16, but the user can develop a sensitive feeling about that because the pusher 24 is operated by hand. After some trials, the user will learn how to end up with an optimum amount of tobacco in the filling chamber 4. In FIG. 3, lid 20 has been pressed all the way down, leaving only a small gap between the bottom face of lid 20 and pusher 24. But the apparatus 1 would also work when the distance between pusher 24 and the bottom of lid 20 is larger, i.e. when the tobacco T is less compressed.

As illustrated in FIG. 3(*a*), a stamp 30 can be vertically moved in a guide space 32 (see FIG. 1(*a*)) in front of the first end wall 16. The stamp 30 extends over the full width of magazine chamber 2, i.e. the inner distance of the side walls 14 in FIG. 3(*b*). The lower side 34 of stamp 30 has an essentially semi-circular cross-sectional shape, see FIG. 3(*a*). Moreover, a cutter 36 is fixed to the side of stamp 30 opposite to the first end 16. The cutter 36 extends over the full width of stamp 30 and comprises a cutting edge 38 protruding somewhat at the lower side 34 of stamp 30.

Figure 4:
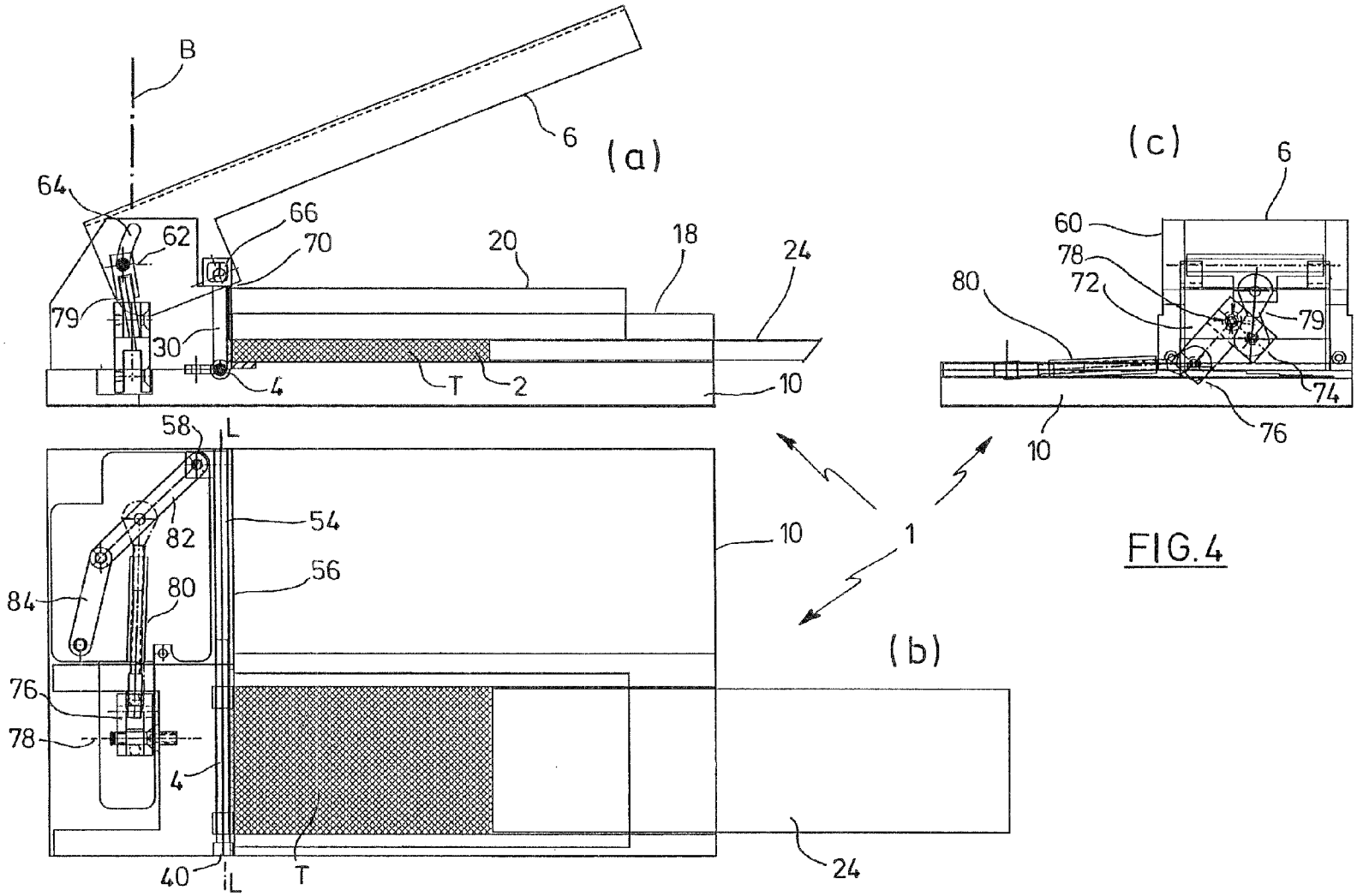

When the press-down lever 6 is pressed down up to the end of its first part of travel, see FIG. 4, the stamp 30 has been moved to its lowermost position. During the downward movement of stamp 30, the cutter 36 cuts the tobacco to be filled into cigarette tube 8 from the rest of the tobacco T in magazine chamber 2, and the tobacco is shaped (which can include some further compression) and completely transferred into the filling chamber 4. As shown in FIG. 4(*a*), the filling chamber 4 has an essentially circular cross-section in this state, its upper portion being formed by the lower side 34 (see FIG. 1(*a*)) of stamp 30 and its lower portion formed by a trough-like recess in the base 10.

One end side of the filling chamber 4 is open, forming an opening 40. The opening 40 is surrounded by a tubular socket 42, see FIGS. 5(*b*), 5(*c*) and 5(*d*). The socket 42 forms a mounting means for cigarette tube 8. In order to facilitate the attachment of cigarette tube 8, socket 42 comprises an oblique end side 44. On its inner wall, the socket 42 includes a step 46, which can be seen in FIG. 5(*d*). By means of a threaded part 48 the socket 42 is screwed into a tapped hole in base 10. The figures do not show the clip which presses the paper of cigarette tube 8 against the socket 42 in order to ensure a safe attachment.

Figure 5:
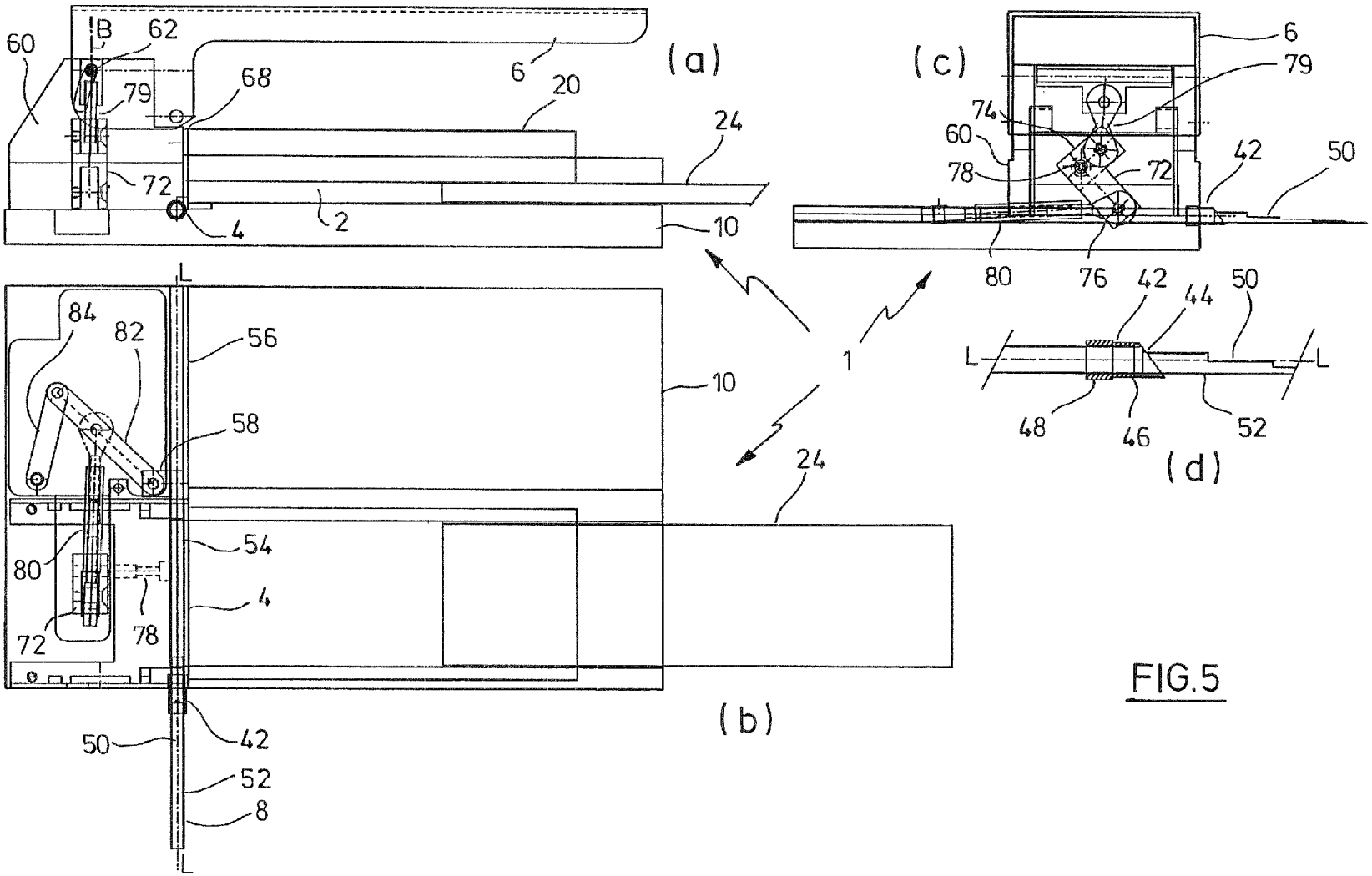

Inside the filling chamber 4, a slider 50 can be moved in the direction of the longitudinal axis L of the filling chamber 4. The slider 50 has a conventional tongue-like extension 52 which extends over the full length or almost the full length of the filling chamber 4. As usual, the tongue-like extension 52 has an arcuate cross-sectional shape and can include undulated or serrated edges. In the embodiment, the tongue-like extension 52 is mounted on a piston-like inner part 54 guided in a hollow guide cylinder 56 provided in base 10, see FIGS. 4(*b*) and 5(*b*). A tab 58 protrudes at the end of part 54 opposite to the tongue-like extension 52. Tab 58 extends through a longitudinal slot in the guide cylinder 56. In the embodiment, the guide cylinder 56 has approximately the length of filling chamber 4. In the state shown in FIG. 4(*b*), the tab 58 is at one end of the travel path of slider 50, the tongue-like extension 52 being fully retracted inside the filling chamber 4. When the slider 50 is moved in the longitudinal direction L of the filling chamber 4 by means of a mechanism to be explained below, the tongue-like extension 52 emerges from the opening 40 and enters into the cigarette tube 8, thus transferring the tobacco of the filling chamber 4 into the cigarette tube 8. FIG. 5(*b*) shows the end point of the travel path of slider 50. When, afterwards, slider 50 is retracted into the filling chamber 4, the tobacco inside the cigarette tube 8 abuts against the step 46 inside the socket 42, which prevents the tobacco from being removed from the cigarette tube 8.

In the following, the mechanism for driving the pusher 24 and the slider 50 by means of the press-down lever 6 is explained in detail, see FIGS. 4 and 5.

The press-down lever 6 is mounted in a bearing section 60 adjoining the guide space 32 of stamp 30. During the first part of its travel, the press-down lever 6 rotates about an axis which is called first fulcrum 62. In the embodiment, the first fulcrum 62 is formed by a shaft, which is guided by an arcuate slot 64 on each side of the apparatus 1. During the states illustrated in FIGS. 1, 2 and 3 and, when the press-down lever 6 is pressed down, up to the end of its first part of travel, as shown in FIG. 4, the first fulcrum 62 rests at the lower end of the arcuate slots 64. This is achieved by spring means (not shown in the figures) which urge the shaft of the first fulcrum 62 towards the base 10. These spring means are strong enough to counteract the pressing forces during the first part of travel of the press-down lever 6.

The upper area of the stamp 30 is connected to the press-down lever 6 by means of a hinge 66 allowing for some clearance as required when the stamp 30 is precisely guided in the guide space 32 (see FIG. 1(*a*)). Thus, during its first part of travel, the press-down lever 6 drives the stamp 30 towards the base 10 until a stop face 68 (see FIGS. 3(*a*) and 5(*a*)) provided at the bearing section 60 is reached, see FIG. 4(*a*).

When the downward force onto press-down lever 6 continues to act, the stop face 68 forms a second fulcrum 70 about which the press-down lever 6 begins to rotate. Now, the forces of the spring means pressing or pulling down the shaft of the first fulcrum 62 are overcome, and the shaft of the first fulcrum 62 begins to rise. During this second part of the travel of press-down lever 6, the shaft of the first fulcrum 62 is guided in the arcuate slots 64. FIG. 5 shows the state when the press-down lever 6 has reached its lowermost position, i.e. when the shaft of the first fulcrum 62 abuts the upper ends of the arcuate slots 64. The stamp 30 is not moved during the second part of travel of press-down lever 6.

As seen in FIGS. 4 and 5, an elbow lever 72 is a primary component of the coupling mechanism connecting the press-down lever 6 to the tab 58 of the slider 50. The elbow lever 72 comprises a first arm 74 and a second arm 76 and is swivelably mounted at a fixed pivot point 78. The first arm 74 is connected, by means of a joint, to a link piece 79 mounted to the shaft of the first fulcrum 62. The end of the second arm 76 is linked to a connection 80.

FIGS. 4(*c*) and 5(*c*) demonstrate that the roughly vertically upward motion of the shaft of the first fulcrum 62 is translated into a roughly horizontal motion of the connection 80 in the area of base 10. The end of connection 80 is joined to a transmission lever 82 mounted at the end of a swivelable link bar 84. The transmission lever 82 is connected to tab 58 and increases the translational path length of the connection 80 to the translational path length required for driving the slider 50 along the filling chamber 4.

When the press-down lever 6 is released, the spring means acting onto the shaft of the first fulcrum 62 revert the motion of the components from the state shown in FIG. 5 to that shown in FIG. 4, and additional spring means lift the press-down lever 6 including stamp 30 to its initial position shown in FIGS. 1 to 3. After removing the finished cigarette, the user can mount a fresh cigarette tube 8 and operate the apparatus 1 again, in the same way as described before. The supply of tobacco T in the magazine chamber 2 is sufficient for a large number of cigarettes.

In the embodiment described above, when the shaft of the first fulcrum 62 begins to rise and the second fulcrum 70 becomes active, the forces of the spring means pressing or pulling down the shaft of the first fulcrum 62 are overcome. This results in a sudden increase of the force required to actuate the press-down lever. Different designs of the mechanism, which allow for a smoother actuation and a less rapid increase in press-down force, are conceivable as well.

The magazine chamber 2 of the embodiment described by means of FIGS. 1 to 5 has a length (measured in the moving direction of pusher 24) of 18.0 cm (length of tobacco T in FIG. 1(*a*)) and a width (corresponding to the length of the filling chamber 4 in the longitudinal direction thereof) of 6.8 cm (or for shorter cigarettes, e.g., 6.2 cm). Before closing lid 20, the height of magazine chamber 2 up to the upper edge of side walls 14 is 2.2 cm. After fully closing lid 20, the residual height of magazine chamber 2 is 1.0 cm. When, initially, loose tobacco T is filled into the magazine chamber 2 up to the upper edge of side walls 14 (which is sufficient for about 30 cigarettes) and, afterwards, lid 20 is fully closed, the tobacco T is compressed by a factor 2.2/1.0=2.2, resulting in an increase of the density of the tobacco by a factor of 2.2. Moreover, before actuating slider 50 for the first time, it is recommended to move the pusher 24 by about 4 cm or 5 cm towards the first end 16 of magazine chamber 2 so that the overall increase of the tobacco density during these steps is about a factor of 3. Of course, other numerical values are possible as well.

As described in the introductory part, the pusher 24 can comprise marks which facilitate the positioning of the pusher, e.g., a mark for indicating the recommended starting position of the pusher after the mentioned shift of 4 cm or 5 cm (or more than one of such marks, depending on the kind of tobacco used) and marks for indicating subsequent moves in steps of one tobacco portion each.

Figure 6:
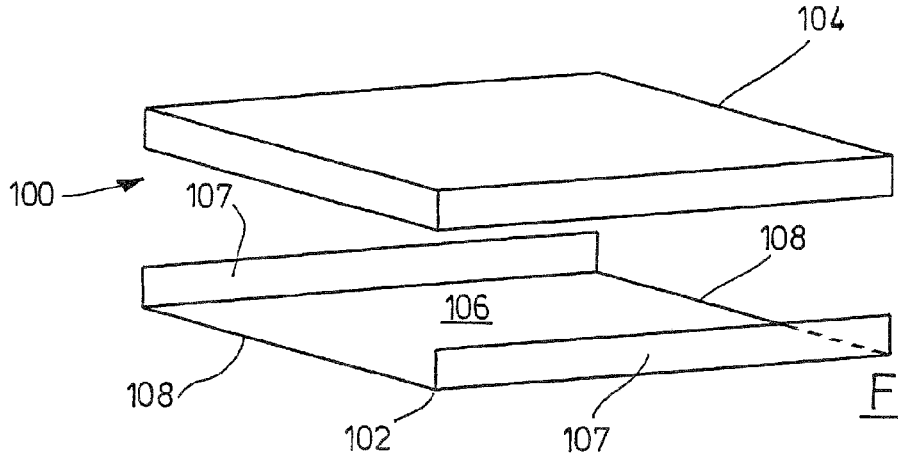

FIG. 6 illustrates an embodiment of a packaging 100 for loose tobacco which comprises an insert 102 and a lid 104. The insert 102 is formed (e.g., from cardboard) as a trough-like part having a bottom wall 106 and two side walls 107 opposite to each other and being open at both end sides 108. The bottom wall 106 and the side walls 107 of the trough-like part 102 fit into gaps between the pusher 24 and the base wall 12 of the magazine chamber 2 and between the pusher 24 and the side walls 14 of the magazine chamber 2. In its state of delivery, the packaging 100 is closed by the lid 104 (e.g., of cardboard) covering the top side and the end sides 108 of the trough-like part 102 and overlapping the side walls 107 of the trough-like part 102. The packaging 100 is filled with tobacco (which, in that example, is somewhat pre-compressed).

In order to transfer this tobacco into the magazine chamber 2 of apparatus 1, the closed packaging 100 is inserted in the magazine chamber 2 when the pusher 24 is in its fully retracted position. Thereafter, the lid 104 is lifted from the insert 102 and removed. The insert 102 can remain in the magazine chamber 2 because it does not interfere with the movement of the pusher 24.

In a variant of this embodiment, the edge walls of the lid of the packaging have a larger height than the side walls of the insert. This allows for a larger volume of tobacco in the packaging. The tobacco can be compressed by means of the lid 20 of the magazine chamber 2, as described above, because the downward movement of the lid 20 of the magazine chamber 2 is not impeded by any interfering parts of the packaging.

Figure 7:
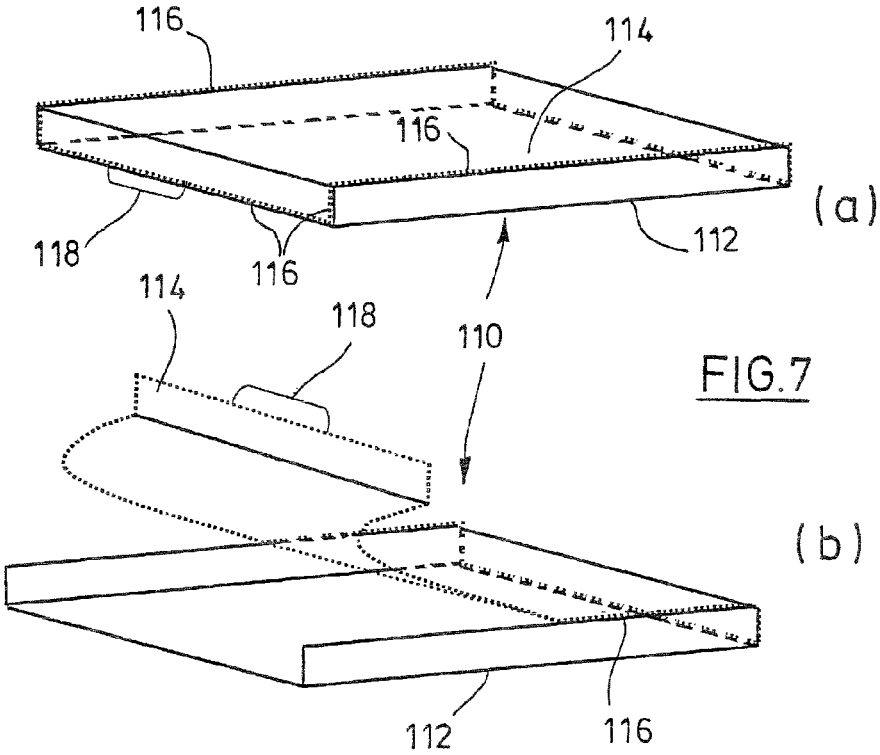

FIG. 7, parts (a) and (b), shows another embodiment of a packaging 110 containing tobacco (here pre-compressed) to be transferred into magazine chamber 2. The packaging 110 comprises an insert 112 designed as in the embodiment of FIG. 6 and a cover 114 made of flexible material, e.g., cardboard, paper, aluminum foil or plastic foil. The cover 114 is attacked to the insert 112 via break lines 116. After the packaging 110 is inserted into magazine chamber 2, the cover 114 is gripped at a tab 118, pulled upwards, thus breaking the break lines 116, and removed, see FIG. 7(*b*).

Figure 8:
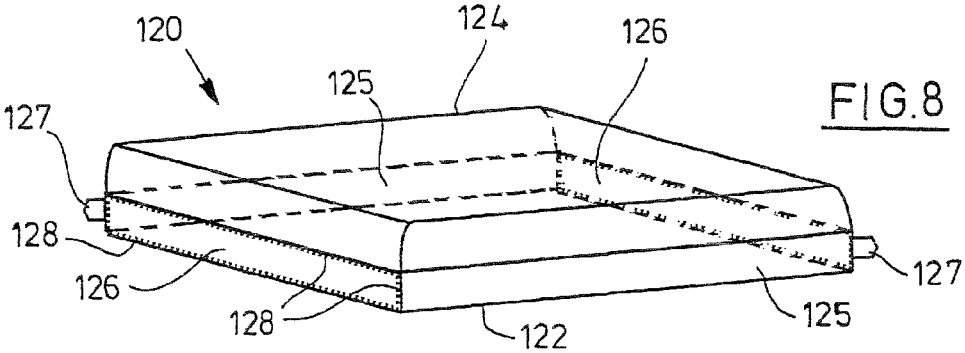

A particular advantageous embodiment of a packaging 120 for tobacco is displayed in FIG. 8. The packaging 120 comprises a trough-like insert 122 which is designed as before. The open areas of the insert 122 are closed by a flexible cover 124 (e.g., of aluminum or plastic foil). The inner space defined by the insert 122 and the cover 124 has a larger height than the height of the side walls 125 of the through-like insert 122. After the packaging 120 has been transferred into the magazine chamber 2, as described before, removable portions 126 of the cover 124 are gripped at tabs 127 and torn away along break lines 128 in order to provide access to the end sides of the insert 122. The rest of the cover 124 remains in the magazine chamber 2. Thereafter, the lid 20 of the magazine chamber 2 is closed and pressed downward, which is easily possible because the cover 124 is flexible. Thus, this embodiment allows for a compression of the tobacco although the tobacco is still largely enclosed by the original packaging 120. A particular advantage of this embodiment is that the contact of the consumer's hands with the tobacco is minimised.

The packagings described by means of FIGS. 6 to 8 avoid soiling of the surroundings of the apparatus 1 by tobacco and facilitate the handling of the apparatus 1.

The packagings described by means of FIGS. 6 to 8 may also be offered to the consumer as a bundle of two or more packagings, wherein at least one common opening flap opens at least one common end side of the bundle.

In the following, a second embodiment of an apparatus for filling cigarette tubes with tobacco is described by means of FIGS. 9 to 15. The apparatus is designated by reference numeral 200. Many of its parts are similar or correspond to parts of the apparatus 1 according to FIGS. 1 to 5. These parts are not explained again; they are indicated by reference numerals calculated from the corresponding reference numerals used in FIGS. 1 to 5 by adding 200.

The main differences between the apparatus 200 and the apparatus 1 are: (1) The lid 220 cannot be removed (except for service purposes by loosening some screws), but it can be lifted and lowered by means of a cam drive in order to fill tobacco into the magazine chamber 202 and to compress the tobacco, as explained below. (2) Whereas in apparatus 1 the tobacco is forwarded towards the filling chamber by means of a manually actuated pusher, the pusher 224 of the apparatus 200 is automatically driven via a coupling mechanism operated by the press-down lever 206 during the initial actuation of the press-down lever 206, as described below in detail. (3) The first fulcrum 262 and the second fulcrum 270 of press-down lever 206 are designed in a different way, as described below. (4) The coupling mechanism connecting the press-down lever 206 to the slider 250 is somewhat different from the corresponding coupling mechanism of apparatus 1, which results in a more space-saving construction.

Figure 9:
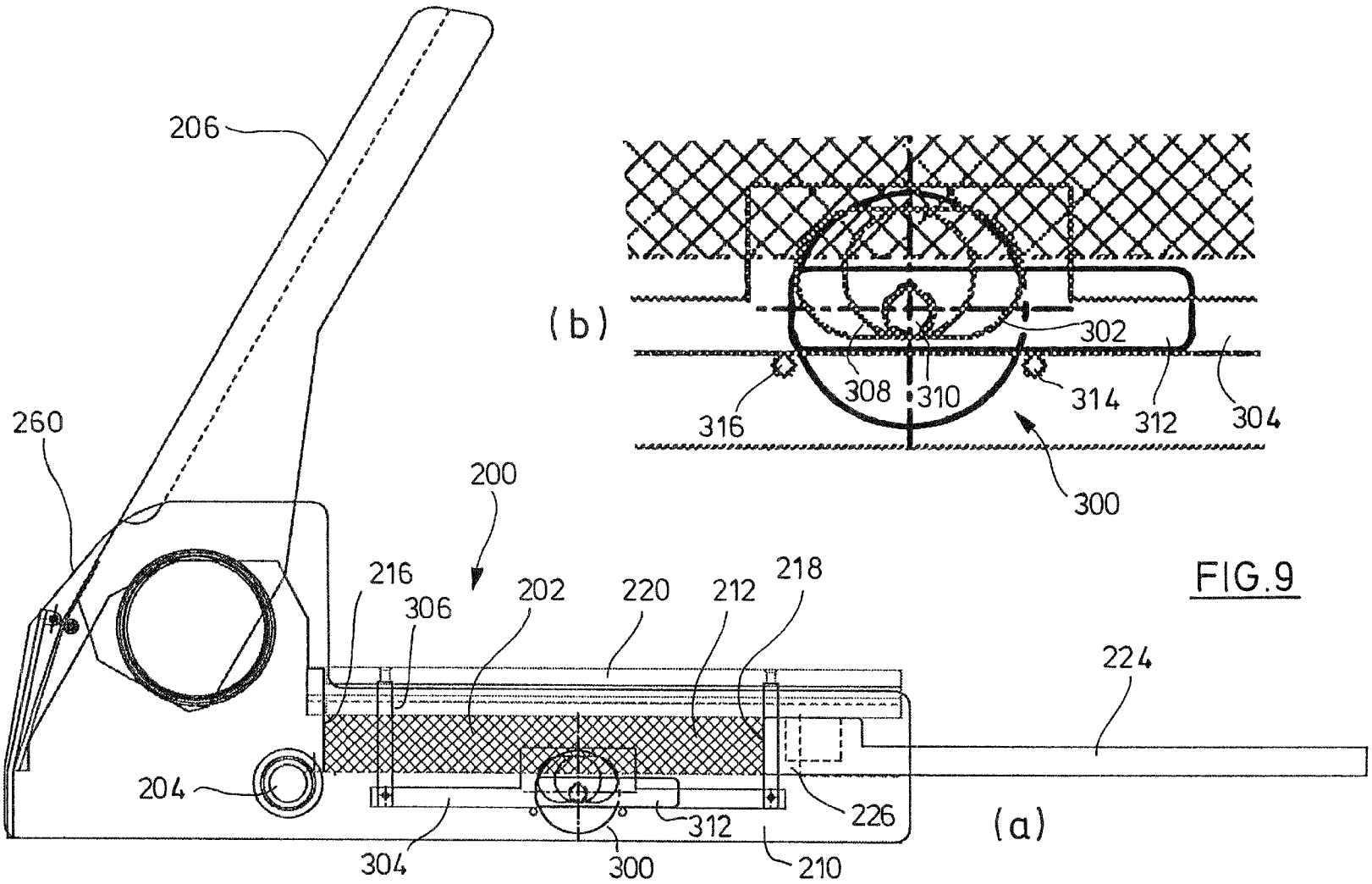
Figure 9:
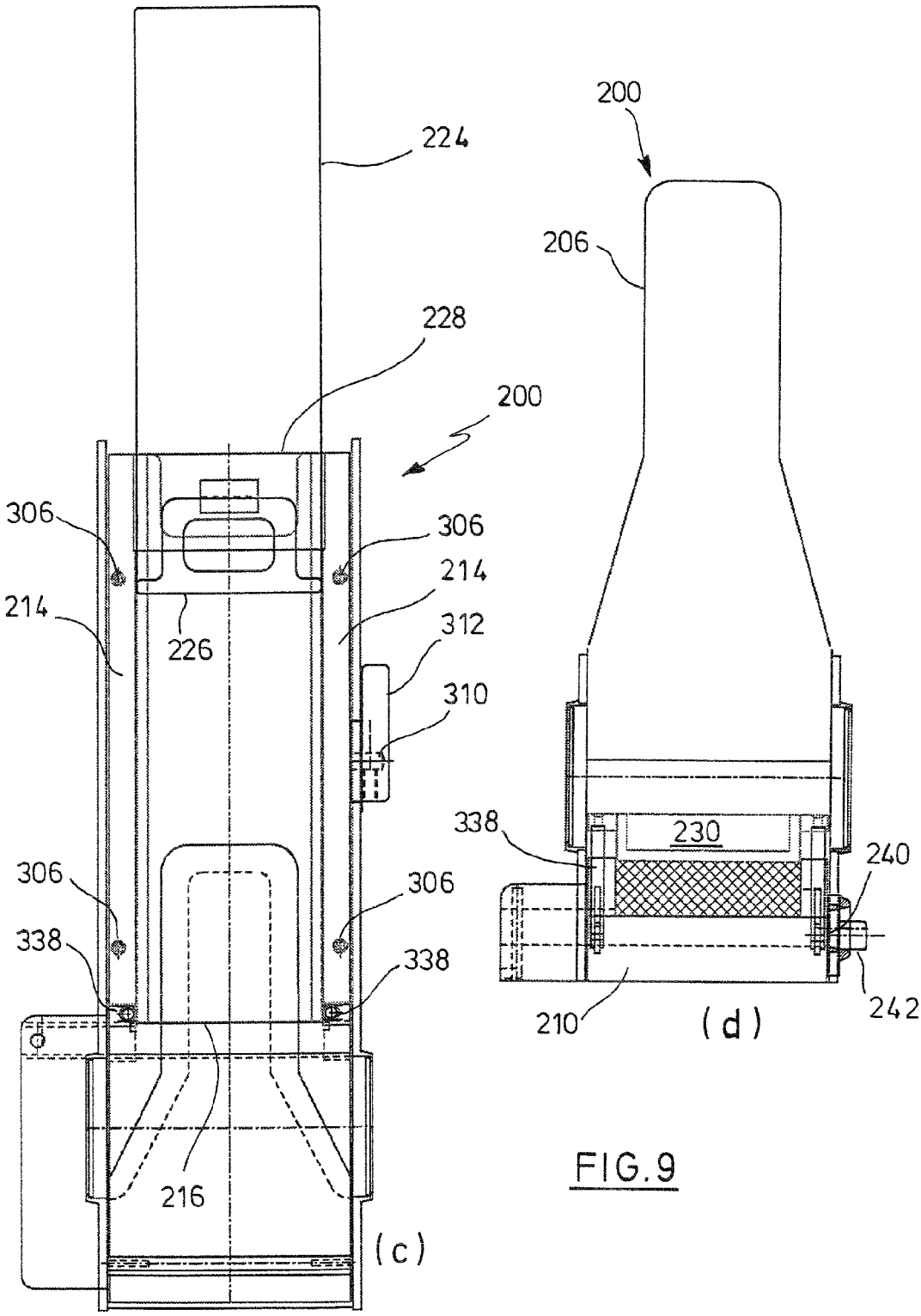

The cam drive, designated by reference numeral 300, is shown in FIGS. 9(*a*) and 9(*b*). It comprises an inner cam 302 designed as a closed curve, which is provided in a connector part 304. The connector part 304 extends over most of the length of the magazine chamber 202 and supports two shafts 306, which are slidably guided in one of the side walls 214 of magazine chamber 202, see FIG. 9(*c*). At the opposite side wall 214, there are another connector part 304 designed in the same way, which also includes an inner cam 302, and two further shafts 306. The lid 220 is attached to the upper ends of the four shafts 306.

In the inner area of each of the inner cams 302, an actuator 308 is eccentrically and rigidly mounted on a rotational shaft 310 which extends over the width of the apparatus 200 and connects both actuators 308. One rotational handle 312 is fixedly mounted to one of the actuators 308, see FIG. 9(*c*). The rotational handle 312 can be turned by about 180° (actually somewhat more than 180°, see below). In the view of FIG. 9, the rotational handle 312 is in its first end position, and it abuts at a first abutment pin 314. If it is turned in the counter-clockwise sense (in the view of FIG. 9(*b*)), it will abut at a second abutment pin 316 where it assumes its second end position.

As it is evident from FIG. 9(*b*), in the first end position of the rotational handle 312, the eccentrically mounted actuator 308 is in its uppermost position so that the lid 220 has its greatest distance from the base wall 212 of magazine chamber 202. When the rotational handle 312 is turned in the counter-clockwise sense, the inner cam 302 of the respective cam drive 300 abuts at the actuator 308 and, due to the shape of the inner cam 302, moves the connector part 304 and the lid 220 downwards, until the rotational handle 312 reaches the second abutment pin 316.

In FIG. 9(*b*), the first abutment pin 314 and the second abutment pin 316 are drawn to indicate a total rotational angle of 180°. It is advantageous, however, when the second abutment pin 316 is attached in a somewhat lower position, resulting in a total rotational angle of more than 180°, e.g. 186°. In this case, the force exerted by compressed tobacco inside the magazine chamber 202 against the bottom side of lid 220 is translated, by the shape of the inner cam 302 in the actual position of the actuator 308 in both cam drives 300, into a torque which drives the device to further increase the rotational angle, but the rotational handle 312 is stopped by the second abutment pin 316. In other words, in spite of the forces exerted by the tobacco, the cam drive 300 also takes a stable position when the lid 220 is in its lowermost (to be precise: almost lowermost) position.

Figure 10:
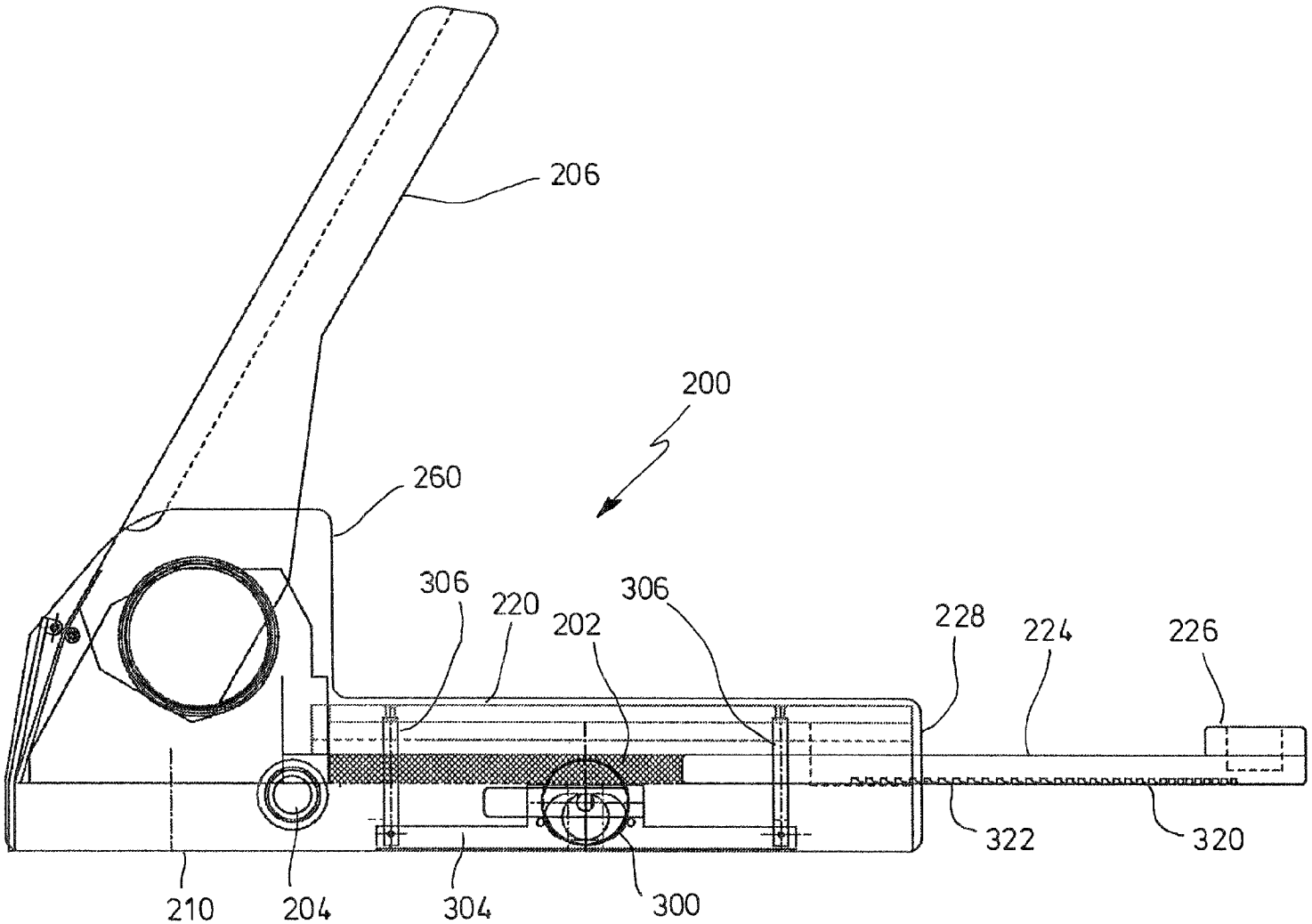

In order to fill tobacco into the magazine chamber 202, the pusher 224 can be used. FIGS. 9(*a*) and 9(*c*) display a state just after the tobacco T has been transferred from a packaging (see below) into magazine chamber 202 by pushing the tobacco by means of the handle 226 of the pusher 224 through an opening at the second end 218 of the magazine chamber 202 into the magazine chamber 202. In the apparatus 200, the handle 226 of pusher 224 has a larger height which is adapted to the size of the packaging and the maximum height of the magazine chamber 202 which is assumed when the lid 220 is in its upper position. Afterwards, the pusher 224 can be retracted from the opening at the second end 218, reversed and introduced again. Now, the handle 226 is outside the magazine chamber 202, as shown in FIG. 10. Actually, the term "handle" for part 226 of the pusher 224 might be somewhat misleading because the pusher 224, in the following steps, is not driven by hand.

In the representation of FIG. 10, the pusher 224 is in its operating state. Moreover, the rotational handle 312 has been turned in order to compress the tobacco in the magazine chamber 202 so that lid 220 is in its (almost) lowermost position.

In apparatus 200, the pusher 224 is automatically driven via the press-down lever 206 in order to forward the tobacco towards the filling chamber 204. To this purpose, the bottom side of pusher 224 is provided with a rack 320, comprising a plurality of teeth 322, see FIG. 11(*a*). The spacing between adjacent teeth 322 increases from the area of the handle 226 to the opposite end area of the pusher 224, see FIG. 11(*a*).

The teeth 322 cooperate with a claw 324 mounted at the end of a bar 326 located underneath the pusher 224 in the area of the base 210 of apparatus 200. The other end of the bar 326 is attached to a sliding carriage 328, see FIG. 11(*a*). The carriage 328 can be moved back and forth (i.e. from the right as in FIG. 11(*a*) to the left as in FIG. 12) by means of some links which are connected to the press-down lever 206. In detail: A first link 330 is swivelably mounted at a fixed bearing point 332. One end of the first link 330 is swivelably connected to a connecting point 334 at the carriage 328. The other end of the first link 330 is swivelably connected to a second link 336 which is swivelably connected to a vertical connector 338 guided in the bearing section 260 of the apparatus 200. The upper end of the vertical connector 338 is linked to a connecting piece 340 which is driven by a shaft forming the second fulcrum 270 of press-down lever 206. The parts 330 to 340 are provided at each of both sides of the apparatus 200, see FIG. 11(*b*).

Figure 11:
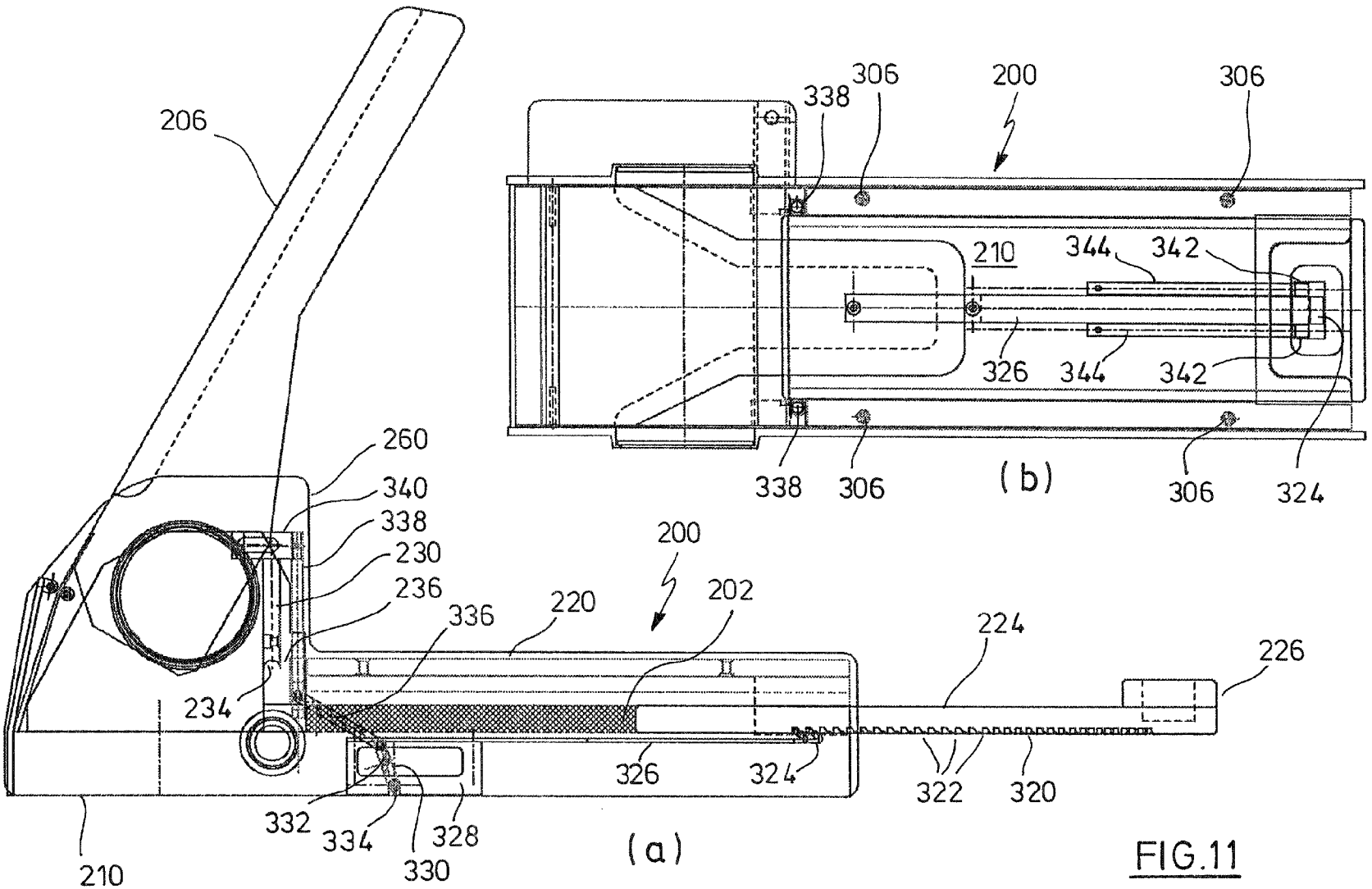

FIG. 11(*b*) also shows two retaining claws 342, each mounted at the free end of a leaf spring 344, the other end of which is fixedly attached in the area of the base 210. When the press-down lever 206 is operated, initially it is in its most raised position as shown in FIG. 11(*a*). In contrast to the apparatus 1, in this state there is a larger distance between the lower side 234 of stamp 230 and the filling chamber 204, see FIG. 11(*a*). This allows for an initial actuation of the press-down lever 206 before the stamp 230 touches tobacco. During the depression of the down-lever 206 from the state shown in FIG. 11(*a*) to the state shown in FIG. 12, which is the initial part of the first part of the travel of the press-down lever 206, the second fulcrum 270 moves downwards and acts onto the vertical connectors 338 and the second link 336, which results in a rotational movement of the first link 330 and a shift of the carriage 328 to the left, see FIGS. 11(*a*) and 12.

Thus, the claw 324 is pulled towards the left, pulling the pusher 224 to the left and transporting tobacco towards the filling chamber 204. Due to the form of the teeth 322, the retaining claws 342 move downwards during this step and do not impede the shift of rack 320. Later, when the press-down lever 206 returns to its initial position of FIG. 11(*a*), the parts 328 to 340 reverse their movement, but the retaining claws 342 abut at the non-sloped edge of a respective tooth 322 and prevent the rack 320 and the pusher 224 from moving backwards. During this step, the claw 324 can yield downwards and finally moves into the area of the next tooth 322.

As already mentioned, the spacing between adjacent teeth 322 is not constant, which results in a decreasing forward shift in the individual steps during the consumption of the tobacco in the magazine chamber 202 and takes into account that the density of the tobacco gradually increases under the action of the pusher 224. In effect, the total amount of tobacco (by weight) transferred to the filling chamber 204 in each step is roughly constant.

In the embodiment, the spacing between adjacent teeth increases from 3.0 mm to 5.0 mm, whereas the stroke of the claw 324 during the back and forth movement of the carriage 328 is 5.5 mm. This choice of numbers ensures that during each step (stroke) exactly one tooth 322 is transported. If the stroke were greater than 6.0 mm, more than one of the narrowly spaced teeth 322 would be transported during one stroke.

Figure 12:
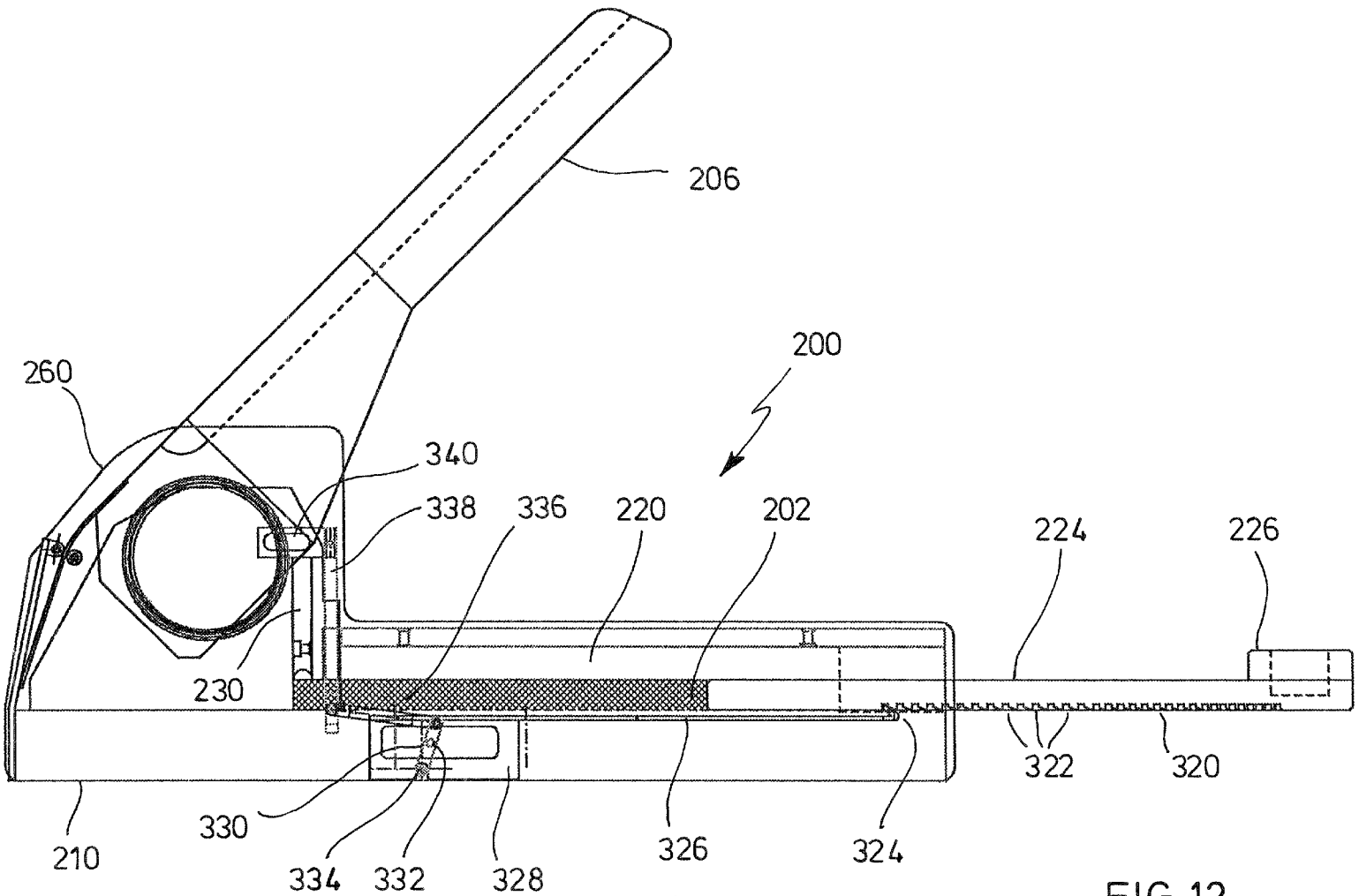

Once the press-down lever 206 has reached the position shown in FIG. 12, the operation of the apparatus 200 is very similar to that of the apparatus 1. Now, the tobacco at the first end 216 of magazine chamber 202 is severed by cutter 236 and transferred into the filling chamber 204, see FIG. 13. The second fulcrum 270 has reached its lowermost position. When the press-down lever 206 is pressed down further, the first fulcrum 262 starts to rise and the second part of the travel of the press-down lever 206 begins.

Figure 14:
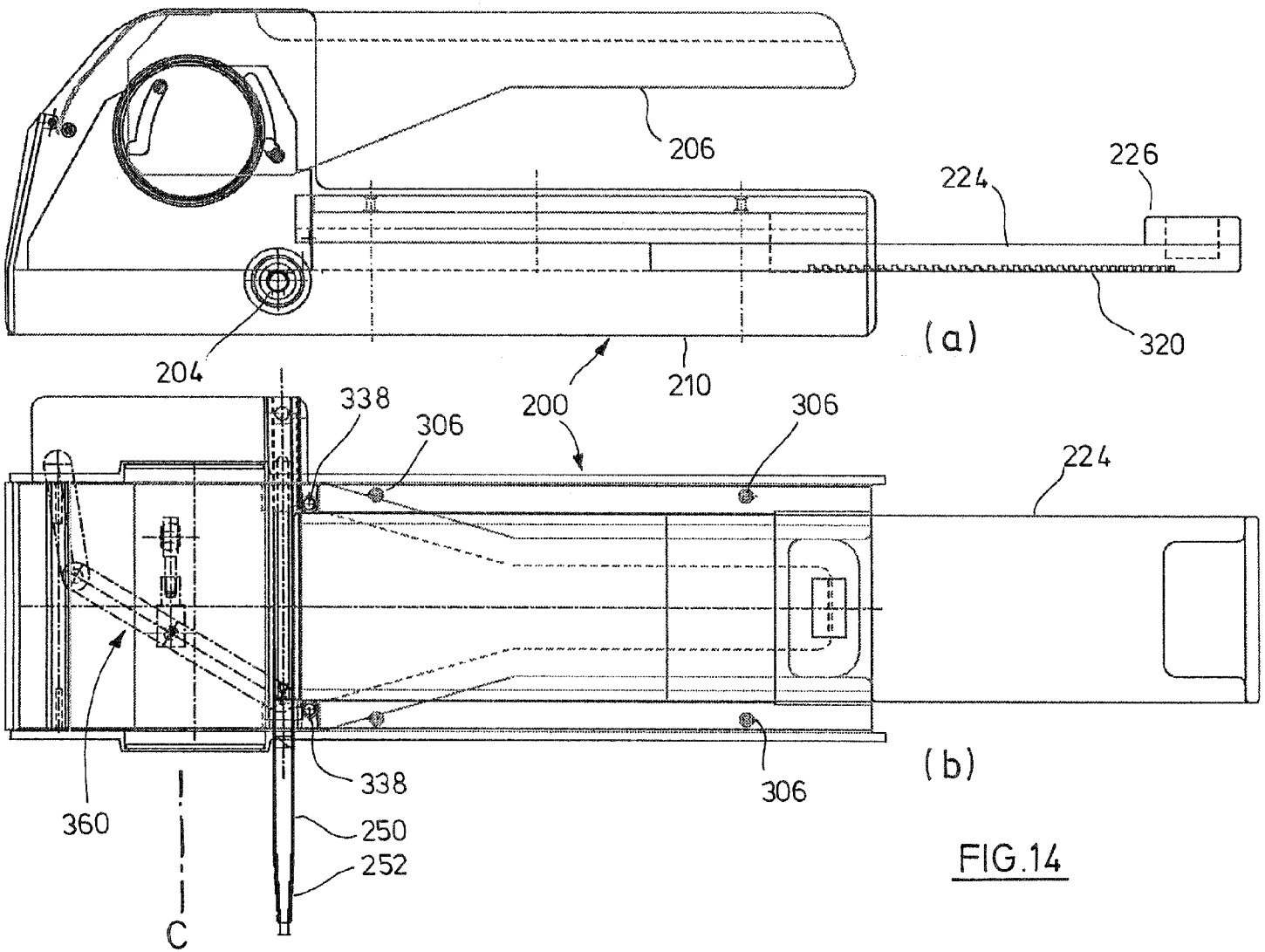
Figure 14C:
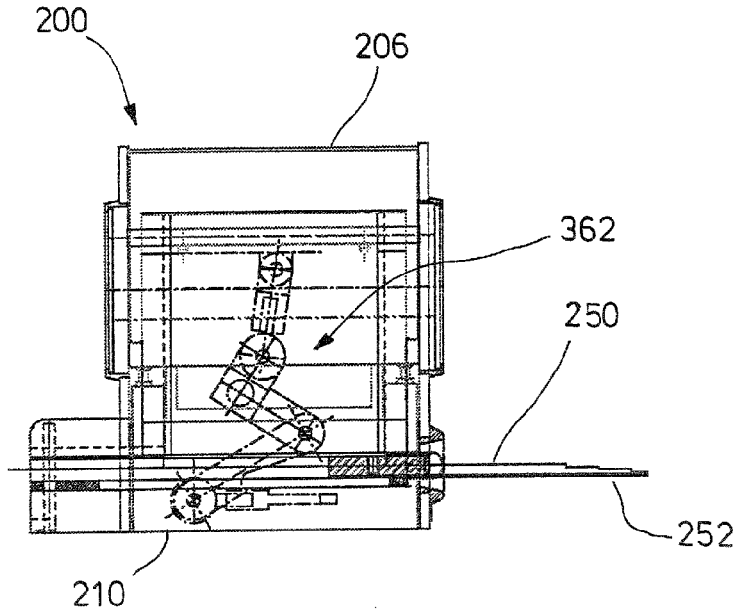

During the second part of travel of the press-down lever 206, which ends when the state shown in FIG. 14 has been reached, the slider 250 is actuated in order to transfer the tobacco portion from the filling chamber 204 into a cigarette tube (not displayed in the figures) attached to the socket 242 (see FIG. 9(*d*)).

Figure 13:
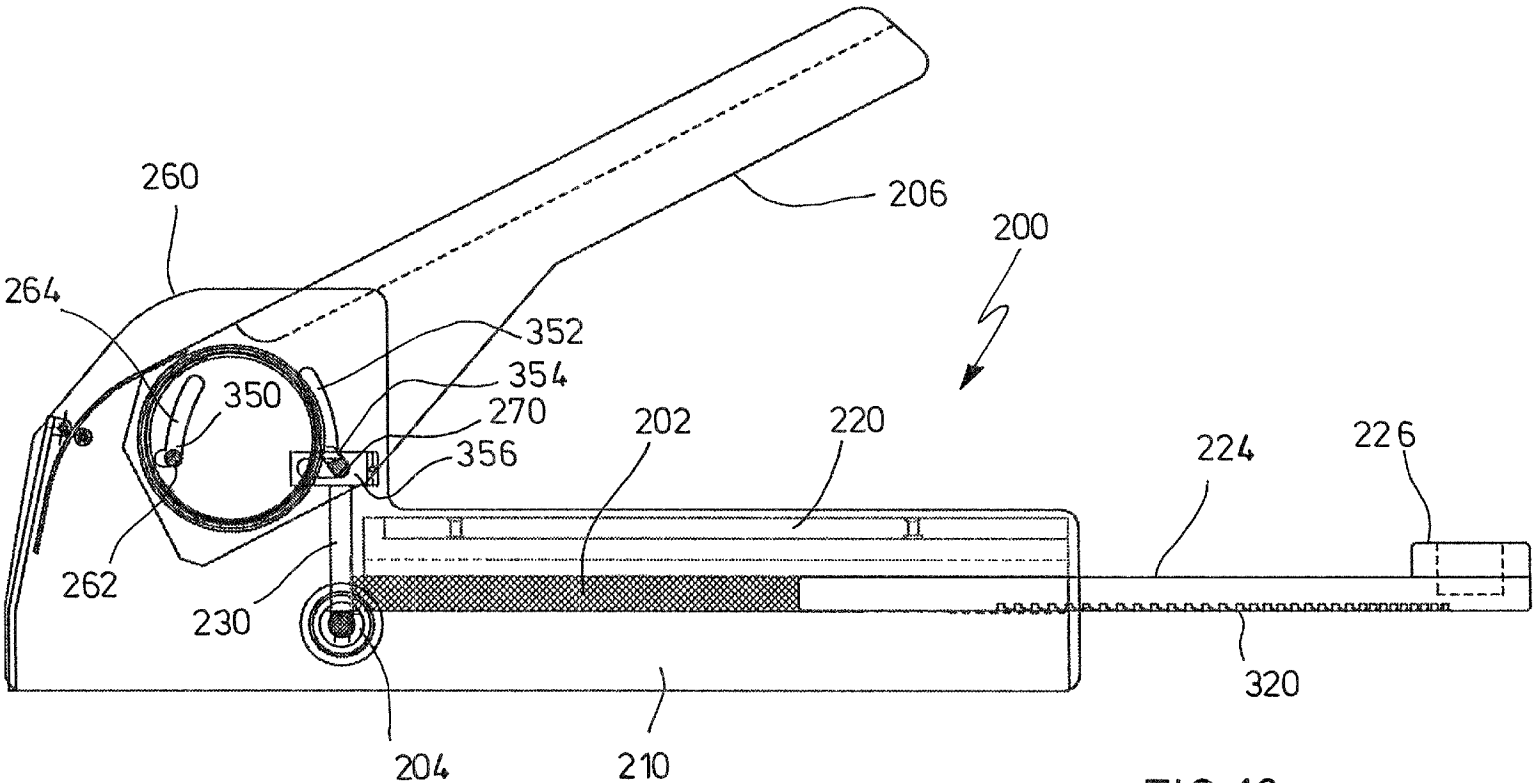

The first fulcrum 262 involves a shaft and is guided by a first guide track 264, see FIGS. 13 and 14. The first guide track 264 comprises a protrusion 350. The second fulcrum 270 of apparatus 200 also includes a shaft, which is guided in a second guide track 352. The guide tracks 264 and 352 are provided on both sides of the bearing section 260. As long as the second fulcrum 270 is guided by the upper portion of each second guide track 352, the protrusion 350 of each first guide track 264 fixes the position of the first fulcrum 262. However, the end portion 354 of each second guide track 354 runs at a different angle until it reaches a stop 356. Since the distance between the shafts of the first fulcrum 262 and the second fulcrum 270 is constant, the first fulcrum 262 is released from the protrusions 350 as soon as the second fulcrum 270 approaches the stop 356. Thus, the first fulcrum 262 can rise in the first guide tracks 264 during the second part of the travel of the press-down lever 206.

In the second part of travel of the press-down lever 206, the slider 250 is actuated by mechanisms 360 and 362, see FIGS. 14(*b*) and 14(*c*). These mechanisms, as is evident from FIG. 14, are slightly different from the corresponding ones of the apparatus 1, which results in a more compact design.

The described cycle of steps is repeated for each complete actuation of the press-down lever 206. When the magazine chamber 202 is empty, the lid 220 is lifted by means of the cam drive 300. Now, the pusher 224 can be raised somewhat in order to interrupt the contact between the claw 324 and the retaining claws 342 to the teeth 322 of the rack 320, and the pusher 224 can be retracted.

Figure 15:
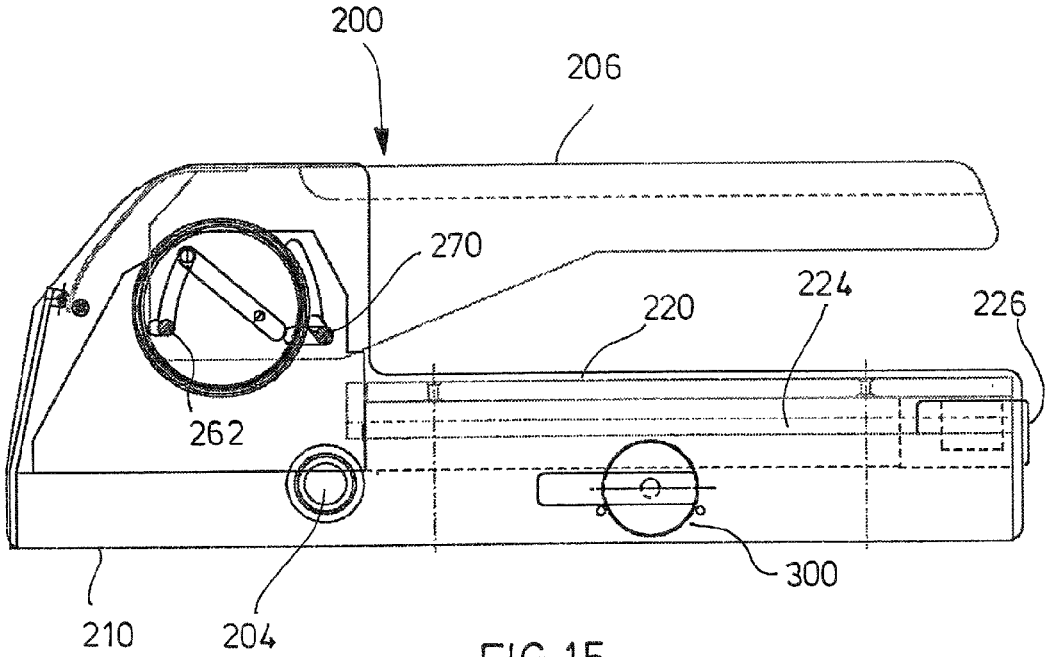

Finally, FIG. 15 shows a resting state of the press-down lever 206. After releasing (e.g., by pressing to buttons, one on each side of the press-down lever 206 in the area of the fulcra 262, 270) a retaining mechanism not shown in the figures, the press-down lever 206 can be turned into this space-saving position.

The FIGS. 16 to 23 illustrate embodiments of packagings containing loose tobacco, which are useful for the application with the apparatus, in particular the apparatus 200 of the second embodiment.

In the embodiments, the packagings are made of aluminium-laminated cardboard. They can be enclosed by a polymer film, e.g. of polypropylene, which aids in preserving the aromas and the moisture content of the tobacco, in particular when the respective packaging includes perforations or other kinds of openings.

Figure 16:
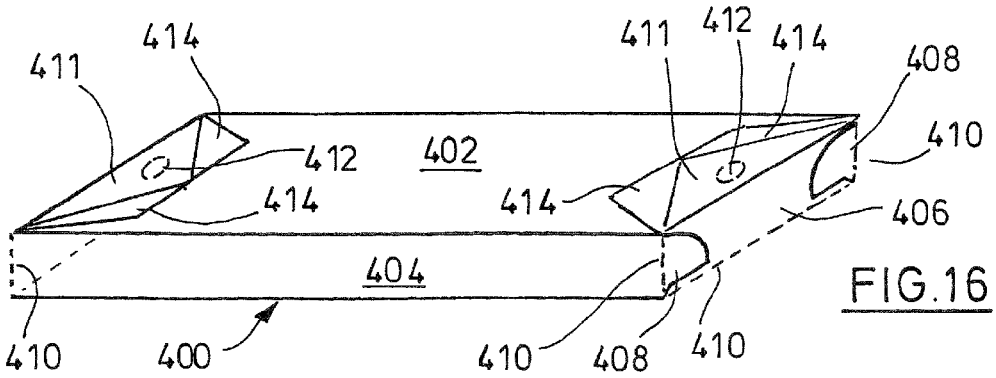

FIG. 16 shows a packaging 400 which has a box shape with two major lateral walls 402, two minor lateral walls 404 and two end walls 406. The packaging 400 is folded from a blank and kept together by means of flaps 408 glued to the outside of the parts forming the end walls 406.

At the end walls 406, there are breaking lines 410 formed as perforations. A flap 411 is slightly fixed by means of a glue point 412. The flap 411 is provided with two gripping tabs 414 which are not glued on the major lateral wall 402.

In order to open the packaging 400, the user grips one of the tabs 414 at one of the end walls 406 and tears away the end wall 406, wherein the respective glue point 412 and the respective breaking lines 410 are destroyed.

After repeating this procedure at the other end side of the packaging 400, the loose tobacco contained in the packaging 400 can be transferred into the magazine chamber of the apparatus 200 by placing the packaging 400 in register with the opening at the second end 218 of magazine chamber 202 and by using the pusher of the apparatus, as already explained by means of FIG. 9.

Figure 17:
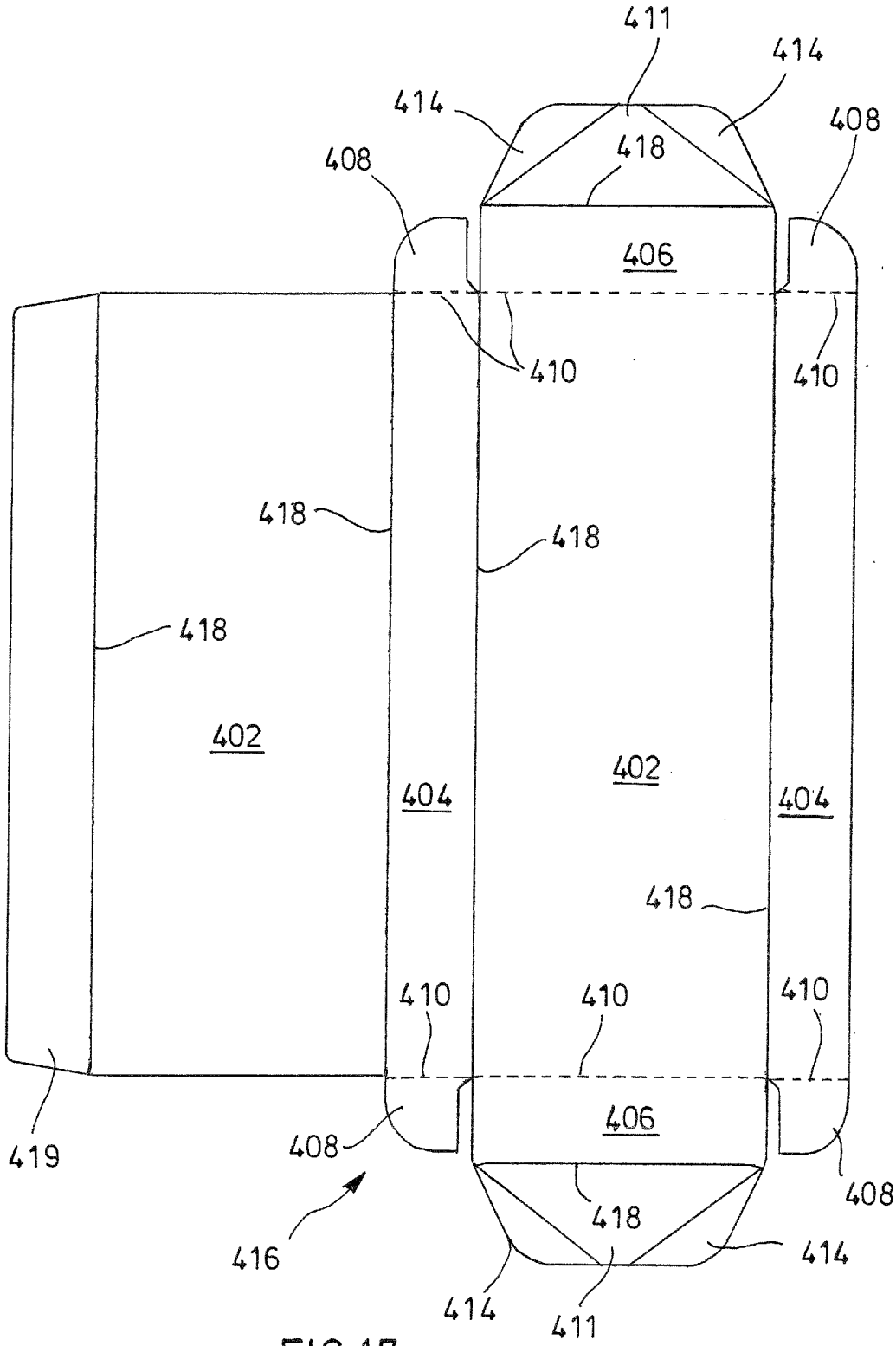

FIG. 17 shows a blank 416 from which the packaging 400 can be folded. Folding lines are indicated by the reference numeral 418. After folding the packaging 400 from the blank 416, the minor lateral wall 404 is not yet glued to flap 419, but this face of the packaging 400 is used for filling the packaging with tobacco. The large access opening provided in this way ensures that the tobacco in the packaging 400 is largely homogeneous. At the end of the filling procedure, the flap 419 and the associated minor lateral wall 404 are glued together. Finally, the outer polymer wrapper is applied.

Figure 18:
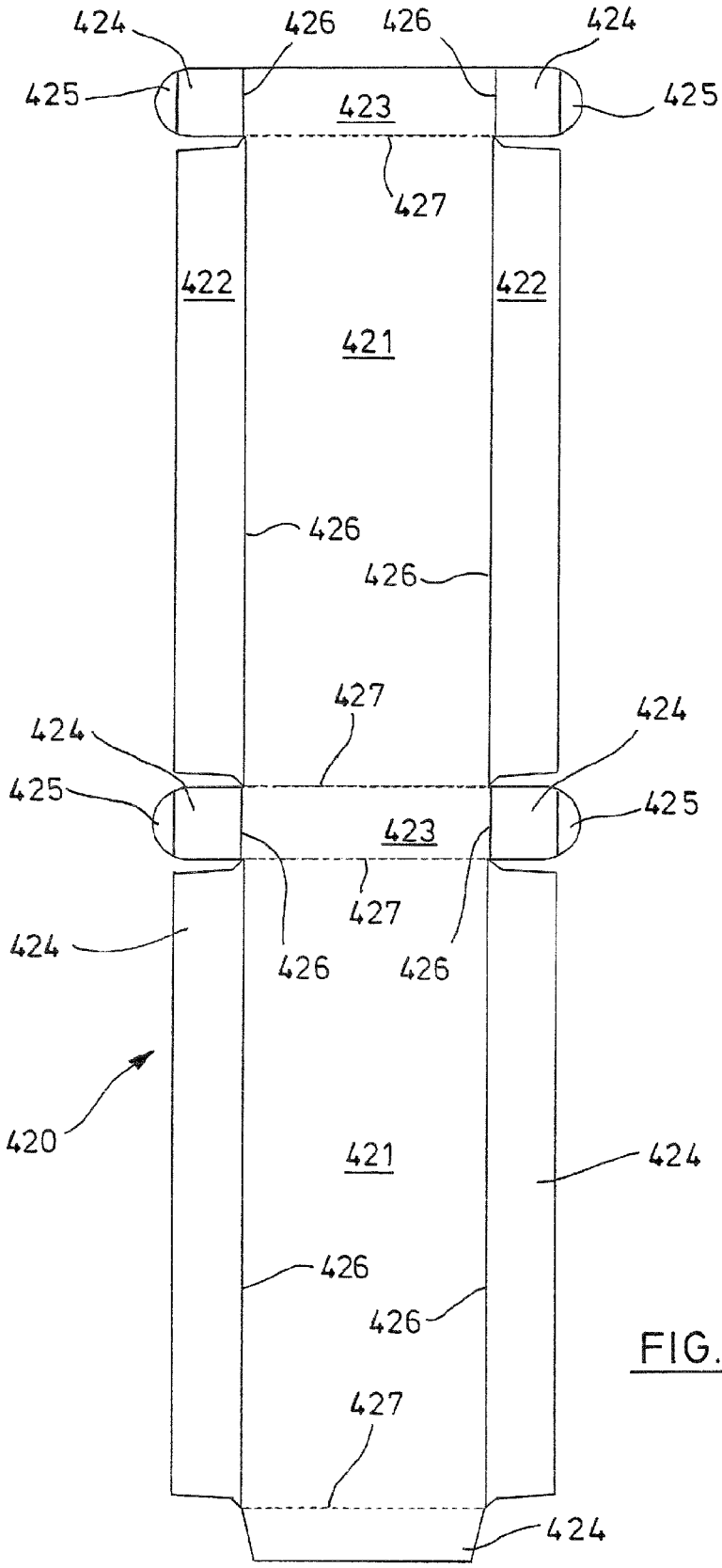

FIG. 18 displays another blank 420, which is designed in a different way but, after folding, results in a packaging similar to the packaging 400. This packaging comprises two major lateral walls 421, two minor lateral walls 422, two end walls 423, flaps 424 to be fixed by glue, gripping tabs 425, folding lines 426 and breaking lines 427. It is used very similar to the packaging 400.

In these embodiments, the packaging contain 17 g of tobacco having a rather low density (about 72 mg/cm$^3$). The size of the packaging 400 is adapted to the size of magazine chamber 202. That means, the tobacco can be transferred from packaging 400 into the magazine chamber 202 without much changing the density of the tobacco. Afterwards, the tobacco is compressed by lowering the lid 220 (e.g., by 10 mm) and by the action of the pusher 224 and of the stamp 230.

It can be advantageous to market packagings having a larger tobacco content, e.g. more than 30 g, but nevertheless to provide a pre-packaged amount of tobacco under well-defined conditions serving as one load for the magazine chamber 202 of apparatus 200. The FIGS. 19 to 23 display several options for such packagings, which are designed as a double pack (twin pack).

Figure 19:
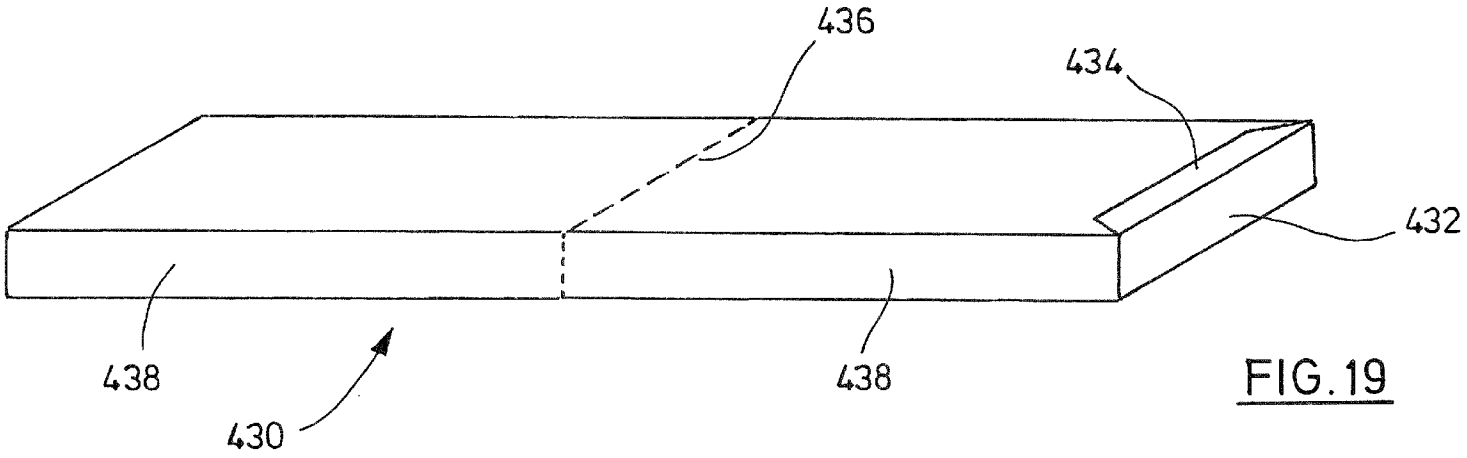

In FIG. 19, an elongate packaging 430 comprises an end wall 432 which can be easily removed by means of a flap 434. Moreover, a perforation line 436 runs about the circumference of the packaging 430, in its center area. When the packaging 430 is broken at the perforation line 436, the user receives two parts 438 with open or easy-two-open end sides, which can be used as described before.

Figure 20:
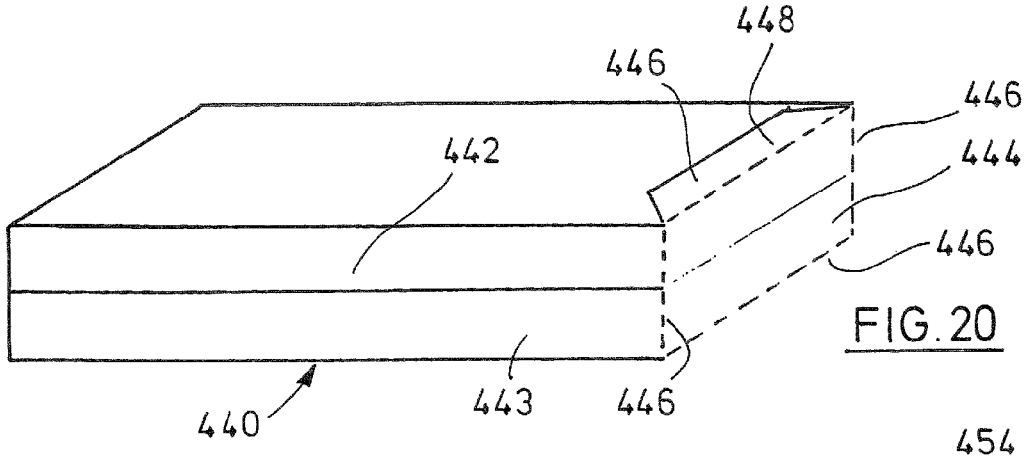

FIG. 20 illustrates another version of a twin packaging 440. It contains two compartments 442 and 443 filled with tobacco. A common end wall 444 is connected via perforations 446 or, depending on the folding process, via flaps like flap 448 or other flaps not shown in the figure, and can be easily removed. After removal of the end wall 444, the tobacco in both compartments 442 and 443 is exposed. The other end wall can be designed in the same way or in a different way.

Figure 21:
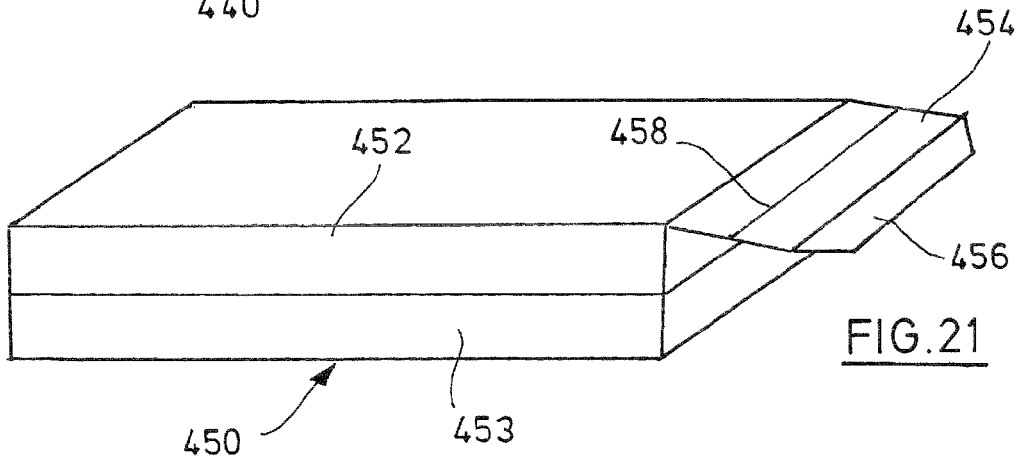

FIG. 21 shows a packaging 450 also comprising two compartments 452 and 453. In this case, a common end wall 454 can be folded into an open state, as indicated in FIG. 21, after breaking glue at a flap 456. Thus, the tobacco in both compartments 452 and 453 is accessible. When the lower compartment 453, which in the embodiment can be easily removed from the upper compartment 452 by loosening some glue points, is used first, the upper compartment 452 can be closed again by the end wall 454, after the end wall 454 has been folded along a folding line 458.

Figure 22:
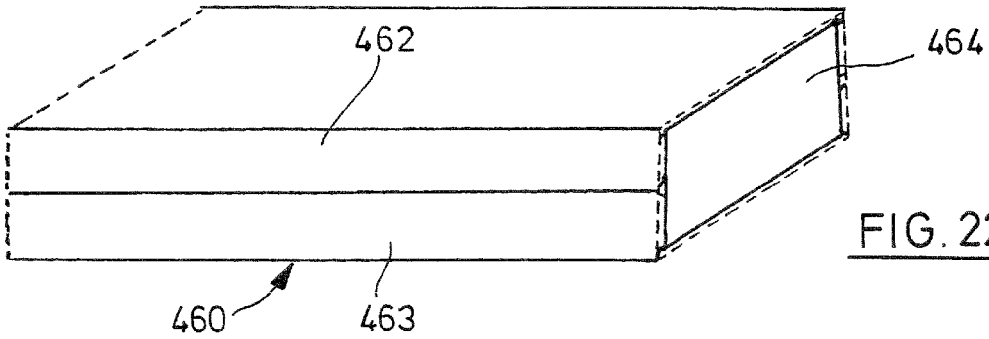

FIG. 22 illustrates a twin packaging 460 which is composed of two partial packagings 462 and 463. The partial packagings 462 and 463 are each designed as the packaging 400, but the corresponding flaps 411 may not be glued to the respective major lateral wall, or another perforation line may be applied, alternatively. In the packaging 460, the end walls of the partial packagings 462 and 463 are covered by a common adhesive tape 464. The packaging 460 can be opened by turning partial packaging 462 around partial packaging 463 (or vice versa) such that the adhesive tape 464 tears the end walls from both partial packagings 462 and 463. The other end side of the packaging 460 can be designed in the same way, or alternatively, individually for each of the partial packagings 462 and 463 like in the packaging 440.

Figure 23:
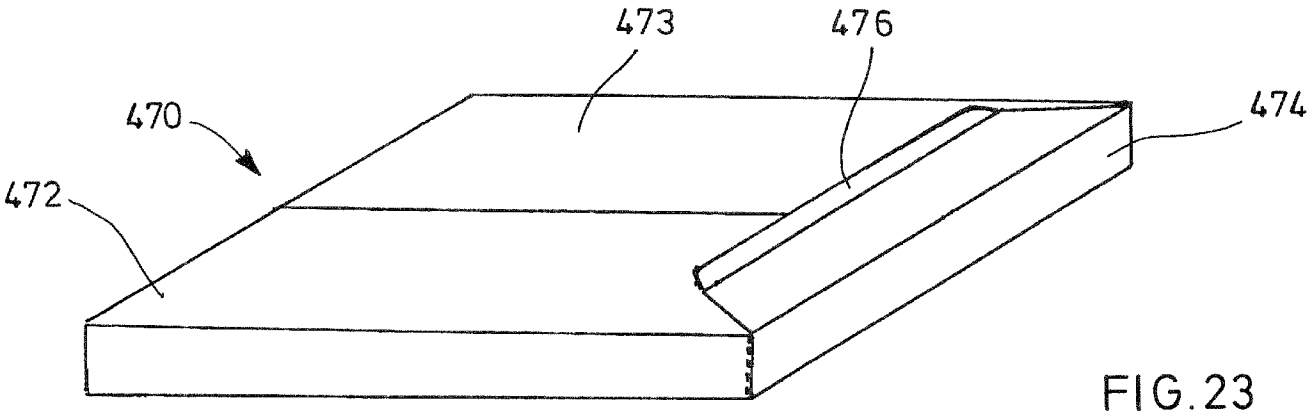

The packaging 470 displayed in FIG. 23 comprises two partial packagings 472 and 473 which touch along one of their minor lateral walls. Again, they are designed like the packaging 400. Two end sides are connected with an additional common flap means 474. The flap means 474 can be easily gripped at a tab 476 in order to tear away the inner end walls the of partial packagings 472, 473 and open both partial packagings 472 and 773 simultaneously. The other end side of the packaging 470 can be designed in the same way or, for each partial packaging 472, 473, like in the packaging 400.

The invention claimed is:

1. Apparatus for filling cigarette tubes with tobacco, said apparatus comprising:

a base;

a magazine chamber adapted to receive a supply of tobacco, said magazine chamber including a base wall, two side walls opposite each other, a first end, and a second end opposite said first end;

a lid adapted to close a top of the magazine chamber;

a pusher adapted to move the tobacco in a moving direction inside the magazine chamber towards said first end;

a filling chamber disposed generally adjacent the first end of the magazine chamber, said filling chamber defining a longitudinal direction transverse to the moving direction of the pusher and being adapted to receive the tobacco to be filled into a cigarette tube;

a stamp movable in a direction transverse to the moving direction of the pusher and transverse to the longitudinal direction of the filling chamber and adapted to shape the tobacco of the filling chamber;

a slider disposed in the filling chamber, said slider being movable in the longitudinal direction of the filling chamber towards an opening in an end side thereof, and being adapted to transfer the tobacco of the filling chamber from the filling chamber via said opening into the cigarette tube supported in front of said opening;

a press-down lever operatively connected to the stamp and being adapted to move the stamp; and a coupling mechanism operatively connected to the press-down lever and being adapted to move the slider after the tobacco has been transferred to the filling chamber and shaped by the stamp, said lid being slidably guided with respect to the magazine chamber and adapted to decrease the volume of the magazine chamber by pressing the lid at least generally in a downward direction that is different from the moving direction.

2. Apparatus according to claim 1, further comprising an eccentric cam drive adapted to move the lid at least generally in an upward direction and at least generally in the downward direction, said upward direction being at least substantially opposite the downward direction.

3. Apparatus according to claim 2, said cam drive including a cam guide, said cam guide being operably connected to the lid and operably engaging an eccentrically mounted, rotatable actuator.

4. Apparatus according to claim 1, further comprising a cutter adapted to separate tobacco to be transferred into the filling chamber from a remainder of the tobacco of the magazine chamber.

5. Apparatus according to claim 1, further comprising a tubular socket disposed about the opening of the filling chamber and adapted to support a cigarette tube.

6. Apparatus according to claim 1, said slider including a tongue-like extension emerging from a piston-like inner part, said tongue-like extension protruding into the cigarette tube when the slider is moved towards the opening of the filling chamber.

7. Apparatus according to claim 1, said filling chamber, including an upper portion thereof defined by the stamp in a lowermost position, presenting a cross-sectional shape that is substantially circular.

8. Apparatus according to claim 1, said press-down lever including a first fulcrum and a second fulcrum, said first and second fulcra being adapted to act as fulcra during different parts of the actuation of the press-down lever, with the first fulcrum acting as a fulcrum and the second fulcrum moving at least generally in the downward direction during the first part of the travel of the press-down lever which is associated to the movement of the stamp, and with the second fulcrum acting as a fulcrum and the first fulcrum moving at least generally in an upward direction that is at least substantially opposite the downward direction during the second part of the travel of the press-down lever which is associated to the movement of the slider.

9. Apparatus according to claim 8, said first fulcrum being adapted to be held in position by spring means as long as it acts as a fulcrum, said second fulcrum, as long as it acts as a fulcrum, being formed at a stop face which limits the first part of the travel of the press-down lever, said first fulcrum being raised against spring force during the second part of the travel of the press-down lever.

10. Apparatus according to claim 8,
said first fulcrum being adapted to be held in position by a protrusion provided at a first guide track as long as it acts as a fulcrum and the second fulcrum, being guided by a second guide track, moves at least generally in the downward direction during the first part of the travel of the press-down lever,
said second guide track being formed to release the first fulcrum when the second fulcrum reaches a stop at a lower end of the second guide track, which limits the first part of the travel of the press-down lever and defines the position of the second fulcrum as long as it acts as a fulcrum,
said first fulcrum being raised along the first guide track during the second part of the travel of the press-down lever.

11. Apparatus according to claim 8,
said coupling mechanism adapted to move the slider comprising an elbow lever including a first arm and a second arm,
said first arm being operatively linked to the first fulcrum and said second arm being adapted to move roughly in parallel to the travel direction of the slider when the first fulcrum is raised.

12. Apparatus according to claim 11,
said second arm of the elbow lever being connected to the slider via additional linkage.

13. Apparatus according to claim 1,
further comprising a second coupling mechanism operatively connected to the press-down lever and being adapted to move the pusher before or during the initial movement of the stamp.

14. Apparatus according to claim 13,
said second coupling mechanism comprising a rack including teeth extending in the moving direction of the pusher, a claw adapted to engage the rack, and a reciprocating device coupled to the movement of the stamp,
said reciprocating device being adapted to pull the claw from an initial position towards the first end of the magazine chamber during the initial movement of the stamp and to move the claw back to the initial position.

15. Apparatus according to claim 14,
said teeth presenting spacing that decreases towards an end of the rack being closer to the second end of the magazine chamber.

16. Apparatus according to claim 1,
said pusher comprising a manual actuating handle.

17. Apparatus according to claim 16,
said manual actuating handle being disposed at a shaft extending through an opening at the second end of the magazine chamber.

18. Apparatus according to claim 1,
said press-down lever being swivellable into a space-saving resting position.

19. Apparatus according to claim 1,
said base wall and said lid, when the lid is in a lowermost position and closes the top side of the magazine chamber, defining a distance therebetween that increases in the moving direction of the pusher towards the first end of the magazine chamber.

20. Apparatus according to claim 1,
said lid, when the lid closes the top side of the magazine chamber, and said base wall defining a distance that increases in the moving direction of the pusher towards the first end of the magazine chamber.

21. System comprising:
an apparatus according to claim 1; and
prepared tobacco for filling into the magazine chamber of the apparatus.

22. System according to claim 21,
said prepared tobacco comprising loose tobacco contained in a packaging including an insert fitting into the magazine chamber and supporting the tobacco as well as a closing device.

23. System according to claim 22,
said insert comprising a trough-like part including a bottom wall and two side walls opposite each other and being open at end sides,
said bottom wall and the side walls of the trough-like part fitting into gaps between the pusher and the base wall and the side walls, respectively, of the magazine chamber.

24. System according to claim 23,
said closing device comprising a liftable lid closing the top side and the end sides of the trough-like part and overlapping the side walls of the trough-like part.

25. System according to claim 23,
said closing device comprising a cover closing the top side and the end sides of the trough-like part,
said cover being connected to the trough-like part along break lines.

26. System according to claim 23,
said closing device comprising a flexible cover closing the top side and the end sides of the trough-like part,
said trough-like part and said cover cooperatively defining an inner space that presents a larger height than the height of the side walls of the trough-like part,
said cover including removable portions in the areas of the end sides of the trough-like part.

27. System according to claim 21,
said prepared tobacco comprising a block of coherent tobacco.

28. System according to claim 21,
said prepared tobacco comprising loose tobacco contained in a packaging,
said packaging presenting a box shape with two major lateral walls, two minor lateral walls, and two end walls,
said packaging being adapted to the size of the magazine chamber, wherein both end walls are attached via weakening zones.

29. System according to claim 21,
said prepared tobacco comprising loose tobacco contained in a packaging,
said packaging presenting a box shape with two major lateral walls, two minor lateral walls, and two end walls,
said packaging being adapted to the width and the height of the magazine chamber, the length of the packaging being greater than the distance between the first end and the second end of the magazine chamber, wherein both end walls of the packaging are attached via weakening zones.

30. System according to claim 29,
said length of the packaging being about twice the distance between the first end and the second end of the magazine chamber, wherein the packaging includes a weakening zone adapted to split the packaging into two parts, with each part presenting a length of about the distance between the first end and the second end of the magazine chamber.

31. System according to claim 28,
said packaging being folded from a blank adapted to allow access to the interior of the packaging for filling purposes via a lateral side before the lateral side is closed to form one of the minor lateral walls.

32. System according to claim 28, said end walls comprising at least one gripping tab adapted to facilitate removal of the respective end wall.

33. System according to claim 21, said prepared tobacco comprising loose tobacco contained in a packaging, said packaging including two compartments, each compartment being adapted to the size of the magazine chamber, wherein the compartments are arranged side by side and the packaging comprises, at least at one end side thereof, an end wall attached via weakening zones, and which also forms the respective end walls of both compartments.

34. System according to claim 33, each compartment being formed as a partial packaging presenting a box shape with two major lateral walls, two minor lateral walls, and two end walls, each partial packaging being adapted to the size of the magazine chamber, wherein both partial packagings are connected, at least at one end side, via a common end wall which is, at least partially, attached via weakening zones.

35. System according to claim 34, wherein, at least at one end side of the packaging, the respective end wall is adapted to remain at one of the partial packagings after use of the other partial packaging and to form a closure for the end side of the remaining partial packaging.

36. System according to claim 28, further comprising another like packaging, wherein the two packagings are arranged side by side to form an arrangement, wherein, at at least one end side of the arrangement, the end sides of both packagings are connected by a common end side cover adapted to simultaneously open the end sides of both packagings.

37. Apparatus according to claim 1, said lid including a guide element in the form of a step.

38. Apparatus according to claim 4, said cutter being fixedly attached to the stamp.

39. Apparatus according to claim 5, said tubular socket including a step on an inner surface thereof.

40. Apparatus according to claim 14, said teeth and said claw being formed to enable the claw to move back to the initial position without shifting the rack.

41. Apparatus according to claim 15, wherein travel of the claw is larger than a maximum spacing of the teeth and is smaller than twice a minimum spacing of the teeth.

42. Apparatus according to claim 1, said lid being adapted to decrease the volume of the magazine chamber by pressing the lid at least generally toward the base wall.

* * * * *